US009149084B2

(12) United States Patent
Turner

(10) Patent No.: US 9,149,084 B2
(45) **Date of Patent: *Oct. 6, 2015**

(54) APPAREL INCORPORATING A PROTECTIVE ELEMENT AND METHOD FOR MAKING

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/927,436

(22) Filed: Jun. 26, 2013

(65) Prior Publication Data

US 2014/0245525 A1 Sep. 4, 2014

Related U.S. Application Data

(63) Continuation-in-part of application No. 13/889,018, filed on May 7, 2013, now Pat. No. 8,713,719, which is a continuation of application No. 13/111,461, filed on May 19, 2011, now Pat. No. 8,438,669, which is a continuation-in-part of application No. 12/490,001, filed on Jun. 23, 2009, now Pat. No. 8,095,996.

(51) Int. Cl.
*A41D 13/05* (2006.01)
*A41D 13/015* (2006.01)
(Continued)

(52) U.S. Cl.
CPC ..... *A41H 43/00* (2013.01); *A41D 13/015* (2013.01); *A41D 13/05* (2013.01); *A41D 13/0543* (2013.01); *A42B 3/125* (2013.01); *A41D 13/0562* (2013.01)

(58) Field of Classification Search
CPC . A41D 13/0153; A41D 13/05; A41D 13/015; A41D 13/0562; A41D 13/0568; A41D 13/0593; A41D 13/0015; A41D 13/0543; A41D 13/0587; A41D 13/0506; A41D 13/0581; A41D 13/065; A41D 13/0156; A41D 13/01; A41D 13/0556; A41D 13/0575; A41D 13/08; A41D 13/02; A41D 1/06; A41D 1/082; A41D 2300/20; A41D 31/005; A41D 13/00; A41D 13/0002; A41D 19/01523; A41D 1/08; A41D 27/00; A63B 2071/125; A63B 2071/1208; A63B 71/1225; A63B 71/08; A63B 2071/1233; A63B 2209/10; A63B 2243/0041; A63B 71/143
See application file for complete search history.

(56) References Cited

U.S. PATENT DOCUMENTS

| | | | |
|---|---|---|---|
| 921,352 | A | 5/1909 | Blaker et al. |
| 1,282,411 | A | 10/1918 | Golembiowski |

(Continued)

FOREIGN PATENT DOCUMENTS

| | | |
|---|---|---|
| CA | 892301 | 2/1972 |
| CA | 2063814 | 1/1991 |

(Continued)

OTHER PUBLICATIONS

Andrew Alderson, "A Triumph of Lateral Thought", in Chemistry & Industry, May 17, 1999; pp. 384-391.

(Continued)

*Primary Examiner* — Bobby Muromoto, Jr.
(74) *Attorney, Agent, or Firm* — Shook, Hardy & Bacon L.L.P.

(57) ABSTRACT

Protective elements for an article of apparel may include a plate component and a cushioning component that are secured together by stitching which passes through the plate component. The cushioning component may include a pair of material layers and at least one pad located between the material layers. The plate component may include a polymer material and the pad may include a polymer foam material, with the polymer material of the plate element having greater rigidity and density than the polymer foam material of the pads. An attachment area may be formed on an outer perimeter of the plate component that is provided with a reduced thickness relative to adjacent areas of the plate component. An attachment element may be passed through the attachment area and at least one layer of the cushioning component thereby attaching the plate component to at least the one layer.

26 Claims, 16 Drawing Sheets

(51) Int. Cl.

| | |
|---|---|
| ***A41H 43/00*** | (2006.01) |
| ***A42B 3/12*** | (2006.01) |
| *A41D 13/00* | (2006.01) |

(56) References Cited

U.S. PATENT DOCUMENTS

| | | | |
|---|---|---|---|
| 1,910,810 | A | 5/1933 | Nash |
| 1,924,677 | A | 8/1933 | Cadgéne |
| 2,266,886 | A | 8/1940 | McCoy |
| 2,569,398 | A | 9/1951 | Burd et al. |
| 2,723,214 | A | 11/1955 | Meyer |
| 2,738,834 | A | 3/1956 | Jaffe et al. |
| 2,751,609 | A | 6/1956 | Oesterling et al. |
| 2,785,739 | A | 3/1957 | McGregor, Jr. et al. |
| 3,012,926 | A | 12/1961 | Wintermute et al. |
| 3,020,186 | A | 2/1962 | Lawrence |
| 3,119,904 | A | 1/1964 | Anson |
| 3,137,746 | A | 6/1964 | Seymour et al. |
| 3,233,885 | A | 2/1966 | Propst |
| 3,258,800 | A | 7/1966 | Robinsky |
| 3,285,768 | A | 11/1966 | Habib |
| 3,293,671 | A | 12/1966 | Griffin |
| 3,305,423 | A | 2/1967 | Le Masson |
| 3,404,406 | A | 10/1968 | Balliet |
| 3,441,638 | A | 4/1969 | Patchell et al. |
| 3,465,364 | A | 9/1969 | Edelson |
| 3,471,865 | A | 10/1969 | Molitoris |
| 3,500,472 | A | 3/1970 | Castellani |
| 3,512,190 | A | 5/1970 | Buff |
| 3,515,625 | A | 6/1970 | Sedlak et al. |
| 3,679,263 | A | 7/1972 | Cadiou |
| 3,722,355 | A | 3/1973 | King |
| 3,746,602 | A | 7/1973 | Caroli et al. |
| 3,746,605 | A | 7/1973 | Dillon et al. |
| 3,772,704 | A | 11/1973 | Carbonneau |
| 3,775,526 | A | 11/1973 | Gilmore |
| 3,832,265 | A | 8/1974 | Denommee |
| 3,867,238 | A | 2/1975 | Johannsen |
| 3,867,239 | A | 2/1975 | Alesi et al. |
| 3,882,547 | A | 5/1975 | Morgan |
| 3,911,185 | A | 10/1975 | Wright, Jr. |
| 3,914,487 | A | 10/1975 | Azoulay |
| 3,922,329 | A | 11/1975 | Kim et al. |
| 3,977,406 | A | 8/1976 | Roth |
| 3,991,420 | A | 11/1976 | Savarino |
| 4,023,213 | A | 5/1977 | Rovani |
| 4,126,177 | A | 11/1978 | Smith et al. |
| 4,136,222 | A | 1/1979 | Jonnes |
| 4,138,283 | A | 2/1979 | Hanusa |
| 4,190,696 | A | 2/1980 | Hart et al. |
| 4,197,342 | A | 4/1980 | Bethe |
| 4,249,302 | A | 2/1981 | Crepeau |
| 4,255,552 | A | 3/1981 | Schollenberger et al. |
| 4,272,850 | A | 6/1981 | Rule |
| 4,276,341 | A | 6/1981 | Tanaka |
| 4,322,858 | A | 4/1982 | Douglas |
| 4,415,622 | A | 11/1983 | Kamat |
| 4,422,183 | A | 12/1983 | Landi et al. |
| 4,440,525 | A | 4/1984 | Perla |
| 4,441,211 | A | 4/1984 | Donzis |
| 4,482,592 | A | 11/1984 | Kramer |
| 4,485,919 | A | 12/1984 | Sandel |
| 4,493,865 | A | 1/1985 | Kuhlmann et al. |
| 4,507,801 | A | 4/1985 | Kavanagh et al. |
| 4,512,037 | A | 4/1985 | Vacanti |
| 4,516,273 | A | 5/1985 | Gregory et al. |
| 4,525,875 | A | 7/1985 | Tomczak |
| 4,534,354 | A | 8/1985 | Bonner, Jr. et al. |
| 4,538,301 | A | 9/1985 | Sawatzki et al. |
| 4,559,251 | A | 12/1985 | Wachi |
| 4,580,297 | A | 4/1986 | Maejima |
| 4,581,186 | A | 4/1986 | Larson |
| 4,599,747 | A | 7/1986 | Robinson |
| 4,631,221 | A | 12/1986 | Disselbeck et al. |
| 4,642,814 | A | 2/1987 | Godfrey |
| 4,646,367 | A | 3/1987 | El Hassen |
| 4,688,269 | A | 8/1987 | Maeshima |
| 4,692,199 | A | 9/1987 | Kozlowski et al. |
| 4,713,854 | A | 12/1987 | Graebe |
| 4,718,214 | A | 1/1988 | Waggoner |
| 4,730,761 | A | 3/1988 | Spano |
| 4,734,306 | A | 3/1988 | Lassiter |
| 4,756,026 | A | 7/1988 | Pierce, Jr. |
| 4,774,724 | A | 10/1988 | Sacks |
| 4,780,167 | A | 10/1988 | Hill |
| 4,809,374 | A | 3/1989 | Saviez |
| 4,852,274 | A | 8/1989 | Wilson |
| 4,856,393 | A | 8/1989 | Braddon |
| 4,867,826 | A | 9/1989 | Wayte |
| 4,884,295 | A | 12/1989 | Cox |
| 4,964,936 | A | 10/1990 | Ferro |
| 4,982,447 | A | 1/1991 | Henson |
| 4,985,931 | A | 1/1991 | Wingo, Jr. |
| 4,985,933 | A | 1/1991 | Lemoine |
| 4,989,265 | A | 2/1991 | Nipper et al. |
| 4,991,230 | A | 2/1991 | Vacanti |
| 5,007,111 | A | 4/1991 | Adams |
| 5,014,354 | A | 5/1991 | Dumont |
| 5,020,156 | A | 6/1991 | Neufalfen |
| 5,020,157 | A | 6/1991 | Dyer |
| 5,029,341 | A | 7/1991 | Wingo, Jr. |
| 5,030,501 | A | 7/1991 | Colvin et al. |
| 5,042,318 | A | 8/1991 | Franz |
| 5,052,052 | A | 10/1991 | Gilford et al. |
| 5,052,053 | A | 10/1991 | Peart et al. |
| 5,060,313 | A | 10/1991 | Neuhalfen |
| 5,067,175 | A | 11/1991 | Gold |
| 5,071,698 | A | 12/1991 | Scheerder et al. |
| 5,129,295 | A | 7/1992 | Geffros et al. |
| 5,160,785 | A | 11/1992 | Davidson, Jr. |
| 5,168,576 | A | 12/1992 | Krent et al. |
| 5,188,879 | A | 2/1993 | Hill et al. |
| 5,214,797 | A | 6/1993 | Tisdale |
| 5,220,691 | A | 6/1993 | Wiegers |
| 5,232,762 | A | 8/1993 | Ruby |
| 5,233,767 | A | 8/1993 | Kramer |
| 5,274,846 | A | 1/1994 | Kolsky |
| 5,289,830 | A | 3/1994 | Levine |
| 5,322,730 | A | 6/1994 | Ou |
| 5,325,537 | A | 7/1994 | Marion |
| 5,337,418 | A | 8/1994 | Kato et al. |
| 5,349,893 | A | 9/1994 | Dunn |
| 5,353,455 | A | 10/1994 | Loving et al. |
| 5,360,653 | A | 11/1994 | Ackley |
| 5,373,584 | A | 12/1994 | Parcells, III |
| 5,380,392 | A | 1/1995 | Imamura et al. |
| 5,399,418 | A | 3/1995 | Hartmanns et al. |
| 5,405,665 | A | 4/1995 | Shukushima et al. |
| 5,407,421 | A | 4/1995 | Goldsmith |
| 5,423,087 | A | 6/1995 | Krent et al. |
| 5,452,477 | A | 9/1995 | Mann |
| 5,459,896 | A | 10/1995 | Raburn et al. |
| 5,477,558 | A | 12/1995 | Volker et al. |
| 5,530,966 | A | 7/1996 | West |
| 5,534,208 | A | 7/1996 | Barr et al. |
| 5,534,343 | A | 7/1996 | Landi et al. |
| 5,551,082 | A | 9/1996 | Stewart et al. |
| 5,594,954 | A | 1/1997 | Huang |
| 5,601,895 | A | 2/1997 | Cunningham |
| 5,614,301 | A | 3/1997 | Katz |
| 5,621,914 | A | 4/1997 | Ramone et al. |
| 5,628,063 | A | 5/1997 | Reed |
| 5,660,572 | A | 8/1997 | Buck |
| 5,675,844 | A | 10/1997 | Guyton et al. |
| 5,689,836 | A | 11/1997 | Fee et al. |
| 5,692,935 | A | 12/1997 | Smith |
| 5,697,101 | A | 12/1997 | Aldridge |
| 5,720,714 | A | 2/1998 | Penrose |
| 5,727,252 | A | 3/1998 | Oetting et al. |
| 5,729,832 | A | 3/1998 | Grilliot et al. |
| 5,738,925 | A | 4/1998 | Chaput |
| 5,780,147 | A | 7/1998 | Sugahara et al. |
| 5,823,981 | A | 10/1998 | Grim et al. |
| 5,915,819 | A | 6/1999 | Gooding |

(56) References Cited

U.S. PATENT DOCUMENTS

| | | | | |
|---|---|---|---|---|
| 5,920,915 | A | 7/1999 | Bainbridge et al. | |
| 5,938,878 | A | 8/1999 | Hurley et al. | |
| 5,940,888 | A | 8/1999 | Sher | |
| 5,948,621 | A | 9/1999 | Turner et al. | |
| 5,987,643 | A | 11/1999 | Beutler | |
| 6,041,447 | A | 3/2000 | Endler | |
| 6,053,005 | A | 4/2000 | Boitnott | |
| 6,070,267 | A | 6/2000 | McKewin | |
| 6,070,273 | A | 6/2000 | Sgro | |
| 6,085,353 | A | 7/2000 | Van der Sleesen | |
| 6,093,468 | A | 7/2000 | Toms et al. | |
| 6,105,162 | A | 8/2000 | Douglas et al. | |
| 6,167,790 | B1 | 1/2001 | Bambara et al. | |
| 6,205,583 | B1 | 3/2001 | Beland | |
| 6,219,852 | B1 | 4/2001 | Bain et al. | |
| 6,235,661 | B1 | 5/2001 | Khanamirian | |
| 6,253,376 | B1 | 7/2001 | Ritter | |
| 6,295,654 | B1 | 10/2001 | Farrell | |
| 6,301,722 | B1 | 10/2001 | Nickerson et al. | |
| 6,317,888 | B1 | 11/2001 | McFarlane | |
| 6,374,409 | B1 | 4/2002 | Galy | |
| 6,401,366 | B2 | 6/2002 | Foxen et al. | |
| 6,485,448 | B2 | 11/2002 | Lamping et al. | |
| 6,510,560 | B1 | 1/2003 | Ugolnik | |
| 6,519,782 | B2 | 2/2003 | Collins et al. | |
| 6,584,616 | B2 | 7/2003 | Godshaw et al. | |
| 6,654,960 | B2 | 12/2003 | Cho | |
| 6,654,962 | B2 | 12/2003 | DeMott | |
| 6,743,325 | B1 | 6/2004 | Taylor | |
| 6,817,039 | B1 | 11/2004 | Grilliot et al. | |
| 6,820,279 | B2 | 11/2004 | Lesosky | |
| 6,841,022 | B2 | 1/2005 | Tsukagoshi et al. | |
| 6,851,124 | B2 | 2/2005 | Munoz et al. | |
| 6,968,573 | B2 | 11/2005 | Silver | |
| 6,969,548 | B1 | 11/2005 | Goldfine | |
| 7,007,356 | B2 | 3/2006 | Cudney et al. | |
| 7,018,351 | B1 | 3/2006 | Iglesias et al. | |
| 7,114,189 | B1 | 10/2006 | Kleinert | |
| 7,188,370 | B2 | 3/2007 | Bevier | |
| 7,316,083 | B2 | 1/2008 | Labonté | |
| 7,350,240 | B2 | 4/2008 | LaGrone | |
| 7,506,384 | B2 | 3/2009 | Ide et al. | |
| 7,512,996 | B2 | 4/2009 | Yoo et al. | |
| RE41,346 | E | 5/2010 | Taylor | |
| 7,707,658 | B2 | 5/2010 | Culhane | |
| 7,743,429 | B2 | 6/2010 | Bevier | |
| 7,761,929 | B1 | 7/2010 | Mascia | |
| 7,832,017 | B2 | 11/2010 | Nascimento et al. | |
| RE42,689 | E | 9/2011 | Taylor | |
| 8,095,996 | B2 * | 1/2012 | Turner | 2/456 |
| RE43,441 | E | 6/2012 | Taylor | |
| 8,231,756 | B2 | 7/2012 | Kim | |
| RE43,994 | E | 2/2013 | Taylor | |
| 8,438,669 | B2 * | 5/2013 | Turner | 2/456 |
| 8,713,719 | B2 * | 5/2014 | Turner | 2/456 |
| 2004/0229763 | A1 | 11/2004 | Hutton, II et al. | |
| 2005/0081277 | A1 | 4/2005 | Matechen et al. | |
| 2005/0167029 | A1 | 8/2005 | Rapaport et al. | |
| 2005/0246812 | A1 | 11/2005 | Bevier | |
| 2005/0268370 | A1 | 12/2005 | Frieler et al. | |
| 2006/0199456 | A1 | 9/2006 | Taylor | |
| 2006/0260026 | A1 | 11/2006 | Doria et al. | |
| 2007/0000005 | A1 | 1/2007 | Wang | |
| 2007/0124843 | A1 | 6/2007 | Bevier | |
| 2008/0178360 | A1 | 7/2008 | Nascimento et al. | |
| 2008/0178361 | A1 | 7/2008 | Yoo et al. | |
| 2008/0264557 | A1 | 10/2008 | Kim | |
| 2008/0290556 | A1 | 11/2008 | Kim | |
| 2009/0070911 | A1 | 3/2009 | Chang | |
| 2009/0152774 | A1 | 6/2009 | Hensley et al. | |
| 2009/0288312 | A1 | 11/2009 | Dua | |
| 2009/0288313 | A1 | 11/2009 | Rapaport et al. | |
| 2010/0024089 | A1 | 2/2010 | Turner | |
| 2010/0024100 | A1 | 2/2010 | Sokolowski et al. | |
| 2010/0024101 | A1 | 2/2010 | Berner et al. | |
| 2010/0129573 | A1 | 5/2010 | Kim | |
| 2010/0193117 | A1 | 8/2010 | Kim | |
| 2010/0199406 | A1 | 8/2010 | Dua et al. | |
| 2010/0205716 | A1 | 8/2010 | Kim | |
| 2010/0205722 | A1 | 8/2010 | Kim | |
| 2010/0206472 | A1 | 8/2010 | Kim | |
| 2010/0319097 | A1 | 12/2010 | Turner | |
| 2011/0277226 | A1 | 11/2011 | Turner | |

FOREIGN PATENT DOCUMENTS

| | | |
|---|---|---|
| CA | 2162723 | 11/1994 |
| CA | 2289622 | 11/1998 |
| CH | 638665 | 10/1983 |
| CN | 2225163 | 4/1996 |
| CN | 2305870 | 2/1999 |
| CN | 102458167 | 5/2012 |
| DE | 3119489 | 12/1982 |
| DE | 3530397 | 3/1987 |
| DE | 9102039 | 2/1991 |
| DE | 4336468 | 4/1995 |
| DE | 29619260 U1 | 2/1997 |
| EP | 254751 | 2/1988 |
| EP | 0083454 | 10/1988 |
| EP | 0552304 | 7/1993 |
| EP | 0595887 | 12/1998 |
| EP | 2445364 | 5/2012 |
| FR | 2740303 | 4/1997 |
| GB | 832101 | 4/1960 |
| GB | 1274569 | 5/1972 |
| GB | 2120167 | 11/1983 |
| GB | 2177892 | 2/1987 |
| GB | 2233877 | 1/1991 |
| JP | 1316235 | 12/1989 |
| JP | 10337797 | 12/1989 |
| JP | 2508289 | 6/1994 |
| JP | 10053905 | 2/1998 |
| WO | WO9723142 | 7/1997 |
| WO | WO9733403 | 9/1997 |
| WO | WO9733493 | 9/1997 |
| WO | WO9736740 | 10/1997 |
| WO | WO9934972 | 7/1999 |
| WO | WO9935926 | 7/1999 |
| WO | WO0050336 | 8/2000 |
| WO | WO0103530 | 1/2001 |
| WO | WO0115892 | 3/2001 |
| WO | WO0216124 | 2/2002 |
| WO | WO02081202 | 10/2002 |
| WO | WO2006036072 | 4/2006 |
| WO | WO2006088734 | 8/2006 |
| WO | WO2010151520 | 12/2010 |

OTHER PUBLICATIONS

Maria Burke, "A Stretch of the Imagination", New Scientist Magazine, vol. 154 issue 2085, Jul. 6, 1997 at p. 36 (available from research.dh.umu.se/dynamic/artiklar/shape/stretch.html, last accessed Nov. 11, 2013).

Joseph Hamill & Carolyn K. Bensel, "Biomechanical Analysis of Military Boots: Phase III", in United States Army Technical Report NATICK/TR-96.013; dated Mar. 11, 1996; 42 pages.

Joseph F. Annis & Paul Webb, "Development of a Space Activity Suit", in NASA Contractor Report NASA CR-1892; dated Nov. 1971; 139 pages.

European Office Action in EPO Application No. 10729742.6, mailed Nov. 6, 2012.

International Search Report and Written Opinion in PCT Application No. PCT/US2010/039426, mailed Oct. 26, 2010.

International Search Report and Written Opinion in PCT Application No. PCT/US2012/038174, mailed Sep. 26, 2012.

Final Office Action in U.S. Appl. No. 13/111,461, mailed Oct. 10, 2012.

Office Action in U.S. Appl. No. 13/889,018, mailed Aug. 20, 2013.

International Preliminary Report on Patentability in PCT Application No. PCT/US2010/039426, mailed Jan. 12, 2012.

Chinese Office Action in Chinese Application No. 201080027246.8, mailed Jun. 5, 2013.

(56) References Cited

OTHER PUBLICATIONS

International Preliminary Report on Patentability (including Written Opinion of the ISA) mailed Jan. 9, 2014 in International Application No. PCT/US2012/043170.

Examiner's Answer Before the Patent Trial and Appeal Board mailed Mar. 12, 2014 in U.S. Appl. No. 13/168,220.

International Search Report with Written Opinion dated Jan. 16, 2015 in PCT Application No. PCT/US2014/044387, 19 pages.

* cited by examiner

APPAREL INCORPORATING A PROTECTIVE ELEMENT AND METHOD FOR MAKING

CROSS-REFERENCE TO RELATED APPLICATION(S)

This application is a continuation-in-part of U.S. Pat. No. 8,713,719, currently U.S. patent application Ser. No. 13/889,018 entitled "Apparel Incorporating A Protective Element", filed on May 7, 2013, which is a continuation of U.S. Pat. No. 8,438,669, which is a continuation-in-part of U.S. Pat. No. 8,095,966, the disclosures of all of which are hereby incorporated by reference.

BACKGROUND

Articles of athletic apparel commonly incorporate elements that cushion or protect an athlete from contact with other athletes, equipment, or the ground. When the protective elements include multiple layers of dissimilar materials, attaching the layers together may be time consuming and require expensive manual labor. Therefore, there is a need in the art for new designs for protective elements and methods of making the protective elements.

SUMMARY

Protective elements for an article of apparel include a plate component and a cushioning component that are secured together by stitching which passes through a thinned portion of the plate component. The thinned portion extends around a periphery of the plate component, and may be co-formed with the molding of the plate or formed after the making of the plate by removing a portion of the edge material of the plate. An attachment element may be passed through the attachment area and at least one layer of the cushioning component thereby attaching the plate component to at least the one layer. In some embodiments, the cushioning component includes a pair of material layers and at least one pad located between the material layers. The plate component is typically made of a polymer material and the pad may include a polymer foam material. The plate element has greater rigidity than the cushioning material of the pads.

In one aspect, the invention includes a protective element for an article of apparel. The protective element includes a first material layer having a first side and an opposite second side. The protective element includes a second material layer associated with the first material layer. A pad component is located between the first material layer and the second material layer. A plate component is positioned adjacent to the first material layer. The plate component is disposed adjacent the first side of the first material layer and the pad component is located adjacent the second side of the first material layer so that the first material layer is disposed between the plate component and the pad component. The plate component has a first portion having a first thickness and a second portion having a second thickness. The first thickness is greater than the second thickness. An attachment area is formed on an outer perimeter of the plate component, wherein the attachment area corresponds to the second portion so that the attachment area has the second thickness. An attachment element attaches the plate component to the first material layer, wherein the attachment element extends entirely through the second thickness of the attachment area.

In another aspect, the invention provides a protective element for an article of apparel including a plate component having a perimeter shape. The protective element includes a first material layer having an exterior surface and an opposing interior surface. The exterior surface is positioned adjacent to the plate component. A pad component having a first surface is positioned adjacent to an interior of the first material layer. A guide pattern is disposed on the exterior surface of the first material layer opposite the interior adjacent the pad component. The guide pattern corresponds to the perimeter shape of the plate component. The plate component is positioned on the first material layer using the guide pattern. An attachment element attaches the plate component to the first material layer proximate the guide pattern.

In another aspect the invention provides a method for making an article of apparel configured with a pad component and a plate component, the method comprising the steps of: (1) placing the pad component adjacent to a first material layer; (2) forming an attachment area on a peripheral edge of the plate component, the attachment area substantially encompassing the plate component; (3) aligning the plate component over the pad component by placement of the plate component on the first material layer; and (4) attaching the plate component to the pad component along the attachment area on the perimeter of the plate component, by inserting an attachment medium through the plate component and at least one of the first material layer and the pad component.

Other systems, methods, features and advantages of the embodiments will be, or will become, apparent to one of ordinary skill in the art upon examination of the following drawings and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures like reference numerals designate corresponding parts throughout the different views.

DETAILED DESCRIPTION

Disclosed herein are various embodiments of protective elements for an article of apparel. In brief for some embodiments, the protective elements generally include a plate component and a cushioning component that are secured together by stitching or staples that pass through a thinned portion of the plate. The thinned portion extends around a periphery of the plate, and may be co-formed with the molding of the plate or formed after the making of the plate by removing a portion of the edge material of the plate. The stitching or staples may extend through the thinned portion of the plate and at least one layer of the cushioning component to secure the plate to the cushioning component. In some embodiments, the cushioning component includes a pair of material layers and at least one pad located between the material layers. The plate is typically made of a polymer material and the cushioning component may include a polymer foam material. The plate is relatively inflexible and rigid to attenuate impact forces. The cushioning material of the pads is softer and more flexible than the plate to deform to absorb impact forces. To ease assembly, the cushioning component is provided with a visible guide pattern for positioning the plate component in the desired location prior to stitching or stapling the plate component onto the cushioning component. The visible guide is roughly the same size and shape as the plate, so that a perimeter of the plate—typically the thinned portion of the plate—corresponds to the visible guide.

Figure 1:
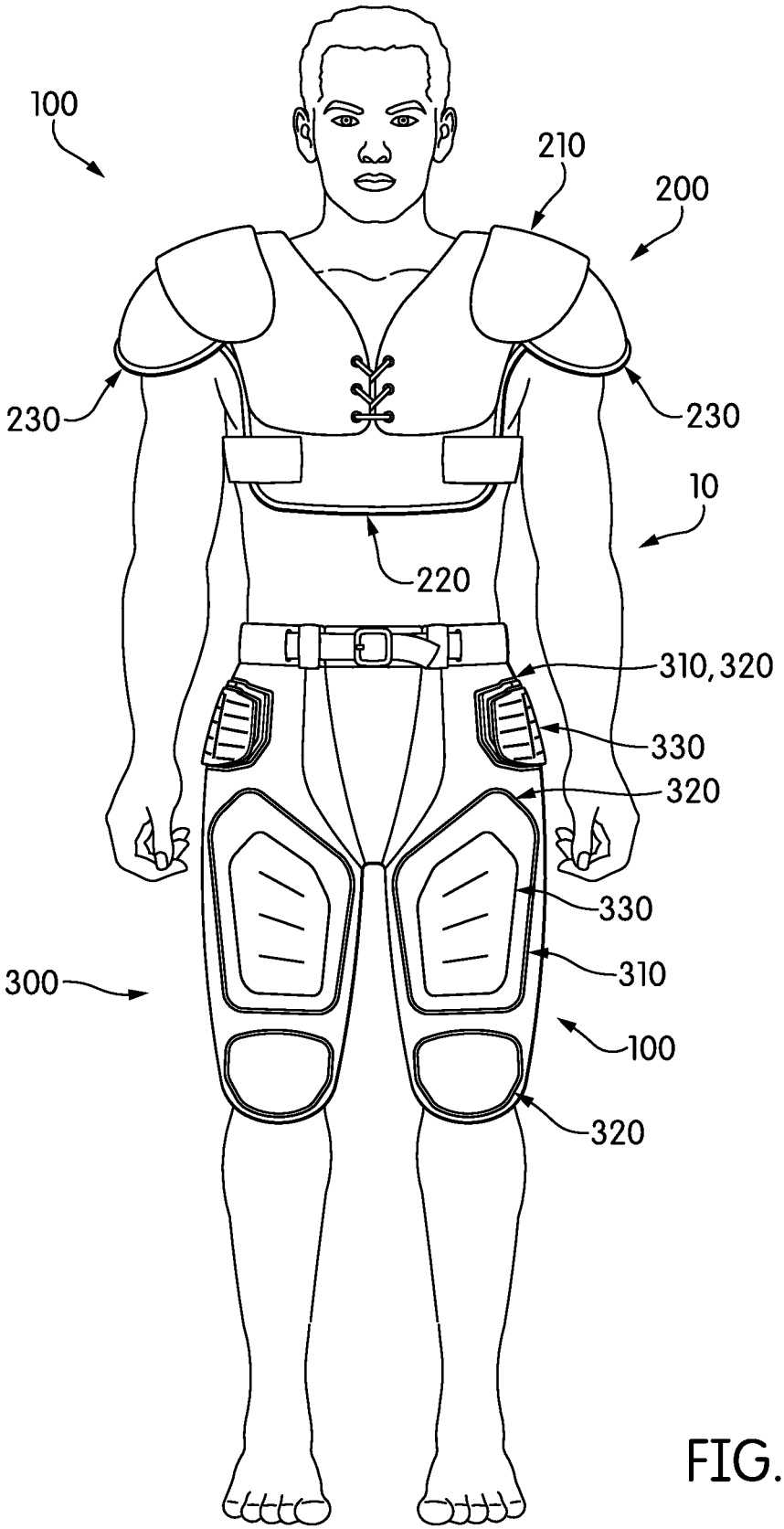
FIG. 1 is a front elevational view of an individual wearing an embodiment of an apparel system having an upper protective garment and a lower protective garment.
Figure 2:
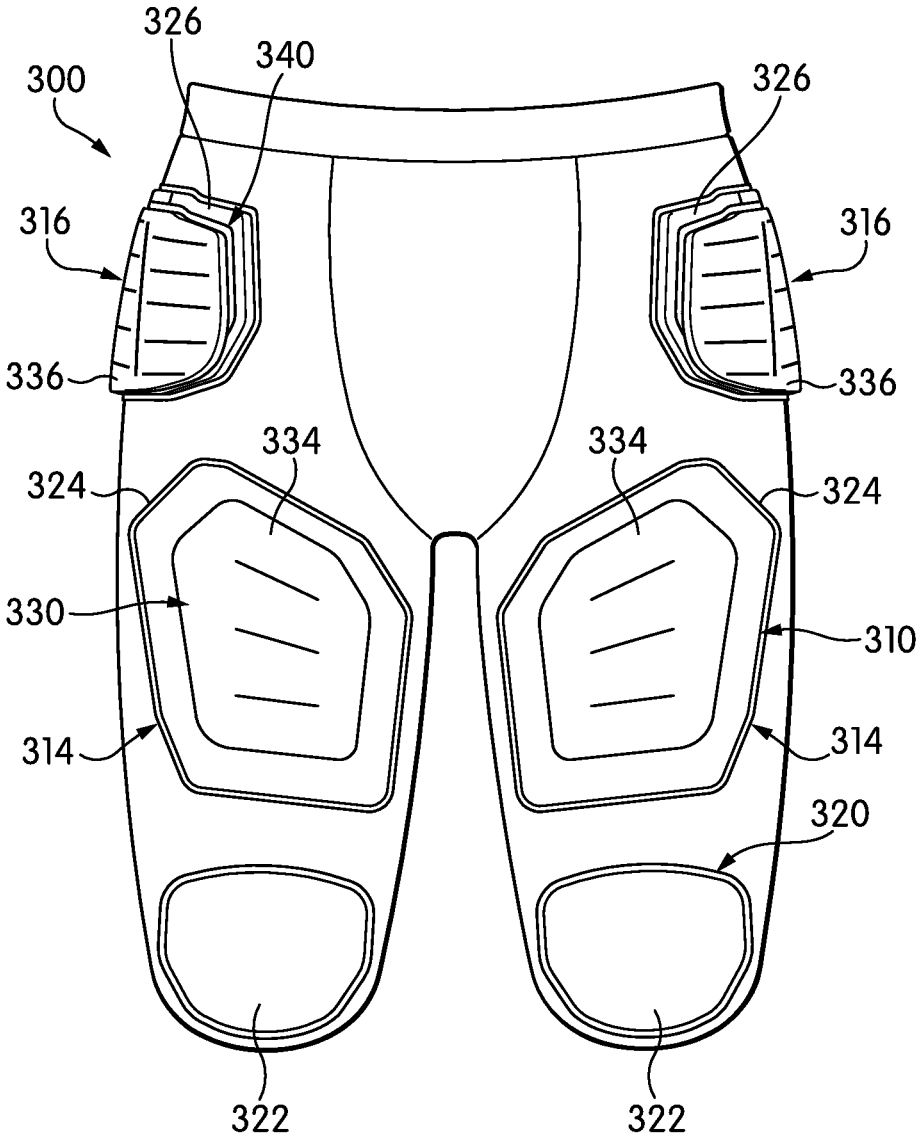
FIG. 2 is a front elevational view of the lower protective garment of FIG. 1.

With reference to FIG. 1, an individual 10 is depicted as wearing an apparel system 100 that includes an exemplary upper protective garment 200 and a lower protective garment 300. Upper protective garment 200 has the general configuration of a shirt-type garment having shoulder pads, which may be utilized in various contact sports, such as American football. Upper protective garment 200 includes a plate component 210, a torso cushioning component 220, and a pair of shoulder cushioning components 230. Plate component 210 covers or extends over an upper torso and shoulders of individual 10. Torso cushioning component 220 is secured to plate component 210 and located between plate component 210 and individual 10. Moreover, torso cushioning component 220 covers or extends over the upper torso and a middle torso of individual 10, thereby extending downward from plate component 210. Shoulder cushioning components 230, which cover or extend over the shoulders, are also secured to plate component 210 and located between plate component 210 and individual 10. In combination, plate component 210, torso cushioning component 220, and shoulder cushioning components 230 impart padding, cushioning, or otherwise attenuate impact forces, thereby imparting protection to individual 10.

An exemplary lower protective garment 300 of apparel system 100 exhibits the general configuration of a pants-type garment, which can include any of a plurality of articles of apparel that cover at least a portion of a pelvic area of individual 10 and may extend over the legs and cover the knees of individual 10. Lower protective garment 300 incorporates cushioning components 320 and protective elements 310 which may include plate components 330 in addition to cushioning components 320. Cushioning components 320 can be positioned on the front, back, or sides of the knee, thigh, hip, and pelvic areas of lower protective garment 300. Plate components 330 may by incorporated with the cushioning components 320 to form protective elements 310 in any desirable area of lower protective garment 300.

In the present configuration, plate components 330 are shown secured to cushioning components 320 in the thigh and hip areas of lower protective garment 300. Cushioning components 320 of protective elements 310 are located between plate components 330 and individual 10. Taken individually or in combination, cushioning components 320, protective elements 310, and plate components 330 impart padding, cushioning, or otherwise attenuate impact forces, thereby imparting protection to individual 10.

Referring now to FIGS. 2 through 5, in an exemplary embodiment of lower protective garment 300, cushioning components 320 are provided in the knee area and back pelvic area, referred to hereinafter as knee cushioning components 322 and rear cushioning component 328, respectively, to impart protection to the corresponding areas of individual 10. Protective elements 310 in the hip area, referred to hereinafter as hip protective elements 316, include hip cushioning components 326 and hip plate components 336 that cooperatively impart protection to the corresponding hip areas of individual 10. Protective elements 310 in the thigh area, herein after referred to as thigh protective elements 314, include thigh cushioning components 324 and thigh plate components 334 that cooperatively impart protection to the corresponding thigh areas of individual 10.

In other configurations of apparel system 100 or lower protective garment 300, cushioning components 320, plate components 330 or protective elements 310 may be positioned in various areas individually or in combination, including the sides or back of the leg regions or in the front or back of the pelvic region, to protect specific portions (e.g., muscles, bones, joints, impact areas) of individual 10. Furthermore, plate components 330 have an overall curved configuration that generally conforms to a shape of individual 10. However, plate components 330 may be depicted as generally planar in the drawings for simplicity. Additionally, the quantity, shapes, sizes, and other properties of cushioning components 320 and plate components 330, as well as the materials utilized in cushioning components 320 and plate components 330, may vary significantly to provide a particular level of protection to the specific portions of individual 10.

Although lower protective garment 300 is depicted as being short pants, various concepts disclosed below may also be applied to other pants-type garments, including pants, briefs, jeans, and underwear. The various concepts disclosed below for lower protective garment 300 may also be applied to upper protective garment 200 and other shirt-type garments, which cover a portion of a torso area of individual 10 and may extend over arms of individual 10. Examples of shirt-type garments include long-sleeved shirts, short-sleeved shirts, tank tops, undershirts, jackets, and coats. In some configurations, articles of apparel incorporating concepts disclosed below for garment 300 may be combinations of shirt-type garments and pants-type garments, including bodysuits, leotards, unitards, and wetsuits. In addition, articles of apparel incorporating concepts disclosed below for garment 300 may have configurations that cover other areas of individual 10, such as hats, helmets, arm and leg wraps, gloves, socks, and footwear, for example.

Although lower protective garment 300 may be worn alone or exposed, lower protective garment 300 may also be worn in combination with other articles of apparel (e.g., under or over other articles of apparel). Apparel system 100 may also be worn in combination with other pieces of equipment (e.g., athletic or protective equipment). In general, lower protective garment 300 is worn over any inner garments, thereby positioning lower protective garment 300 to be the exterior garment worn by individual 10.

In some configurations, cushioning components 320 may be constructed with a pad of polymer foam materials of cushioning components 320. When incorporated into apparel system 100 and protective garment 300, the pad of polymer foam materials of cushioning components 320 may compress to protect a wearer from contact with other athletes, equipment, or the ground. In some configurations, plate components 330 may be formed with semi-rigid or rigid polymer material to attenuate impact forces to provide protection. Plate components 330 may be configured to deform to absorb and distribute impact forces. Accordingly, protective elements 310 incorporating cushioning components 320 and plate components 330 may be utilized to provide protection to areas of individual 10 that are covered by protective elements 310. To explain in further detail, an example is provided below.

Figure 7B:
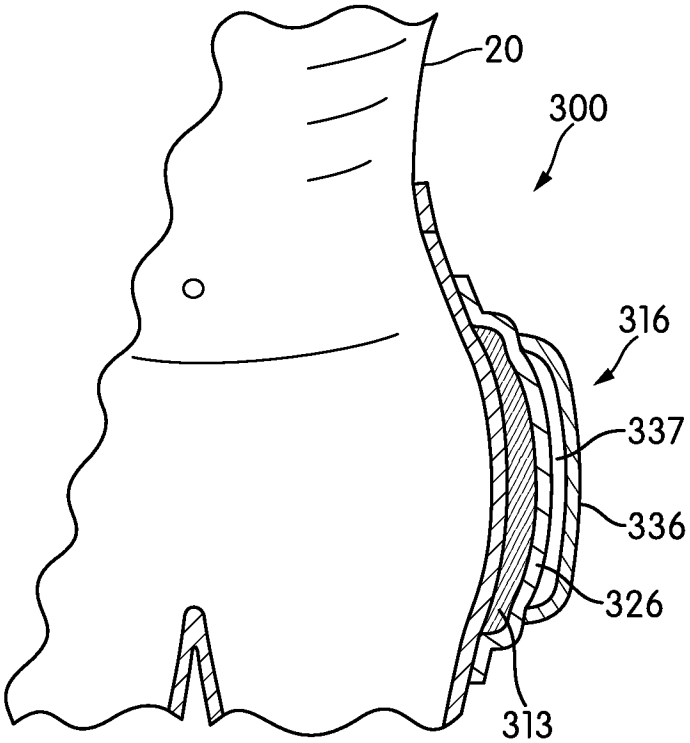
FIG. 7B is a partial cross-sectional view of the first player wearing the lower protective garment of FIG. 7A.
Figure 7A:
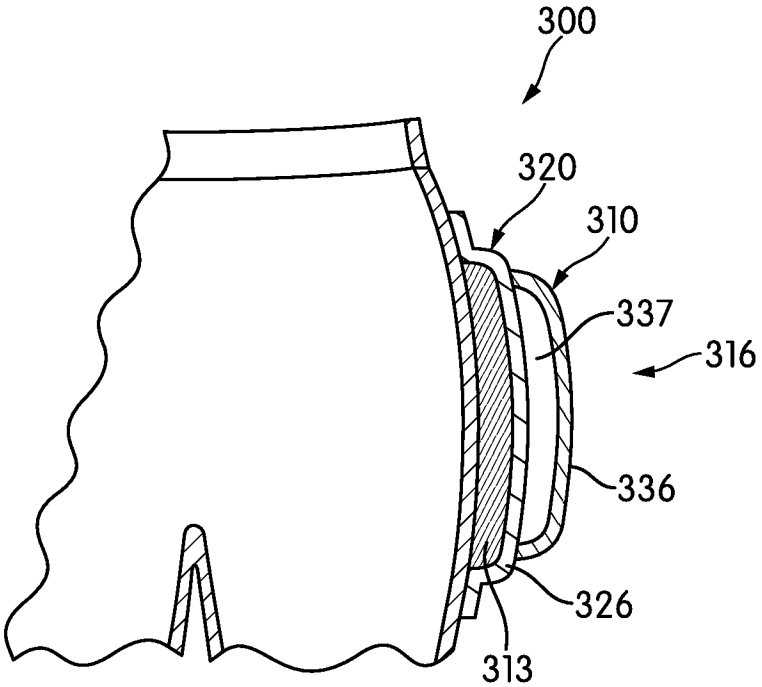
FIG. 7A is a partial cross-sectional view of an embodiment of the lower protective garment.

FIG. 6 and FIGS. 7A through 7C (not to scale) provide an illustration of a collision scenario of a first player 20 with a second player 30. First player 20 is shown wearing an embodiment of apparel system 100, and in particular, wearing an embodiment of lower protective garment 300. In a first position, player 20 is carrying a game ball and running downfield, for example, toward a scoring zone. An exemplary protective element 310 for a hip area of lower protective garment 300 is shown in detail in FIG. 6, and in FIGS. 7A and 7B. In this configuration, hip protective element 316 includes hip cushioning component 326 and hip plate component 336. The hip cushioning component 326 is shown having a generally uniform thickness as can be seen at a peripheral edge 322 of hip cushioning component 326. In FIG. 7A, lower protective garment is shown before being worn by first player 20. In some embodiments, a space 337 may be provided between an interior of hip plate component 336 and an exterior of hip cushioning component 326. In FIG. 7B, lower protective garment is shown while being worn by first player 20. When first player 20 is wearing lower protective garment 300, space 337 may become partially filled with a portion of hip cushioning component 326, due to the body of first player 20 pressing against the hip cushioning component 326, and due to the compressibility and flexibility of the material of hip cushioning component 326.

In the first position of first player 20, hip plate component 336 is shown in an initial state, with virtually no forces being imparted to hip cushioning component 326 and hip plate component 336, other than from first player 20. The initial state of hip plate component 336 is shown having a generally convex curvature which extends outward from the exterior surface of hip cushioning component 326 with space 337 disposed there between.

Figure 7C:
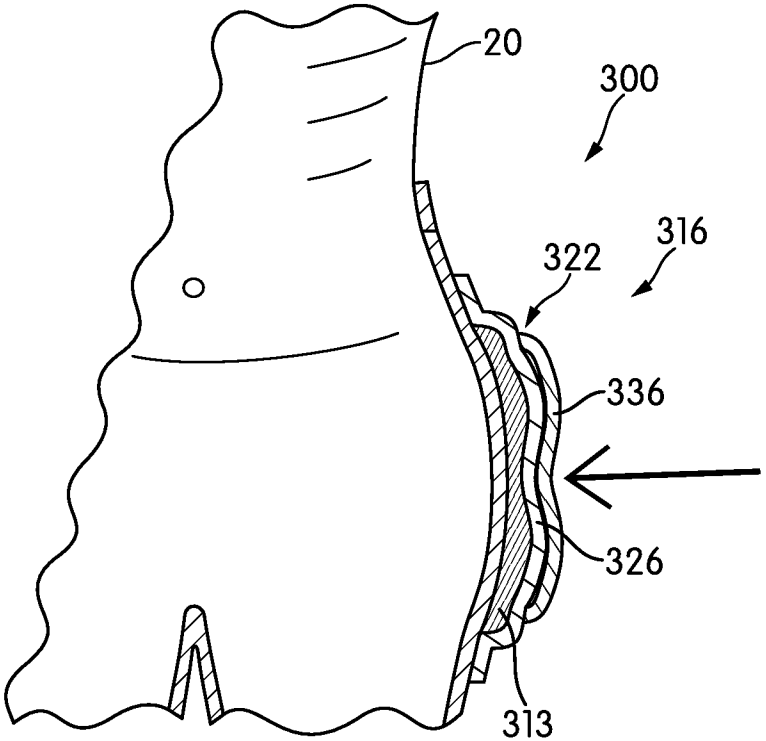
FIG. 7C is a partial cross-sectional view of the first player wearing the lower protective garment of FIG. 7A while an impact force is applied to a protective element in a hip area.

In a second position in the collision scenario, second player 30 is attempting to stop or tackle first player 20, for example. First player 20 is shown being hit in the hip area by the shoulder of second player 30. The second position of exemplary protective element 310 from hip area of lower protective garment 300 is shown in having an impact force from second player 30, as indicated by an arrow in FIG. 6 and FIG. 7C. In this configuration, the hip cushioning component 326 no longer has a uniform thickness but instead is compressed as depicted at the peripheral edge 322 of hip cushioning component 326. Hip plate component 336 is shown in a force attenuating state, in which the impact force is being absorbed and distributed, as the illustrated by zigzag lines. The force attenuating state of hip plate component 336 is further illustrated by the deformed hip plate component 336 having an indented curvature. During impact, hip plate component 336 pushes inward toward the exterior surface of hip cushioning component 326, thereby compressing hip cushioning component 326. Space 337 may be filled during the deformation of hip plate component 336 and compression of hip cushioning component 326, as shown in FIG. 7C.

A plurality of flex indentations 338 may be provided on the exterior of hip plate component 336. Flex indentations 338 are configured to enhance flexibility and enable deformation of hip plate component 336 when exposed to an impact force. The impact force may be absorbed by deformation of the hip plate component 336 along flex indentations 338 into a partially concave shape as shown, for example. Thus, during impact, forces can be absorbed and distributed over a greater area of the hip protective element 316, thereby lessening the blow to first player 20 and second player 30. More or fewer flex indentations 338 may be provided in exemplary hip plate component 336 or for plate components 310 configured for other areas of individual 10.

Also shown are a plurality of seams 328 in the exterior surface of hip cushioning component 326, which are configured to enhance flexibility in those area of the hip cushioning component 326 in which seam 328 are disposed. Generally, areas of cushioning components without seams 328 are stiffer than areas with seams 328. Seams 328 may be formed by a router for example, which can remove a portion of the exterior surface of hip cushioning component 326. In an exemplary embodiment, the exterior surface of hip cushioning component 326 and the underlying material, foam padding for example, may have different colors. The color of pad becomes exposed in the areas where first material layer was removed by a router. Here the exposed pad creates an aesthetically pleasing exterior of protective element 310. Alternatively, seams may be provided by other methods, such as stitching through the cushioning component or partially melting areas of the cushioning component, etc., to create seams 328.

The collision scenario above describes one of many possible scenarios where protective elements 310 are used to protect an individual wearing a lower protective garment incorporating protective elements 310. Advantageously, the protective element remains intact during and after the collision. Some embodiments of protective elements incorporate a hook-and-loop type attachment system for attaching the plate component to the cushioning component. However, in such configurations it is possible for the plate component to become loosened or detached from the cushioning component, which is undesirable because of possible injury to the player or loss or destruction of the plate component. In further embodiments, a more reliable permanent attachment method is provided which is utilized to prevent such an occurrence. In such embodiments, to be described below, the plate component may be securely stitched to the cushioning components. Such permanent attachment methods may be used as an alternative to or in combination with hook-and-loop type or other attachment systems.

FIGS. 8 through 12 illustrate various views of an exemplary embodiment for a protective element 310. In this embodiment, thigh protective element 314 can include thigh cushioning component 324 and thigh plate component 334. Thigh cushioning component 324 includes a first material layer 311, a second material layer 312, at least one pad 313, and thigh plate component 334. In general, pad 313 is positioned between first material layer 311 and second material layer 312. First material layer 311 and second material layer 312 cooperatively form an outer surface or covering for thigh cushioning components 324. That is, first material layer 311 and second material layer 312 cooperatively form a pocket or void, in which pad 313 is located.

Whereas second material layer 312 is depicted as having a generally planar configuration, first material layer 311 extends over pad 313 and also along sides of pad 313 to join with second material layer 312 (e.g., through stitching, an adhesive, or thermal bonding, not shown). Although thigh cushioning component 324 may be incorporated into protective garment 300 in a variety of ways, first material layer 311 may be positioned exterior of second material layer 312. That is, first material layer 311 may form a portion of an exterior surface of lower protective garment 300. An advantage to this configuration is that thigh cushioning component 324 protrudes outward from lower protective garment 300, rather than protruding inward and toward individual 10. In some configurations of protective garment 300, however, other cushioning components 320 may protrude inward.

Additionally, thigh plate component 334 is located at an exterior of thigh cushioning component 324 (i.e., located exterior of first material layer 311). In an exemplary embodiment described above, cushioning components 320 in the hip areas and thigh areas are incorporated with plate components 330. However, further plates are absent from other cushioning components 320, such as in the knee and back pelvic areas. In further configurations, additional plate components 330 may be utilized in other cushioning components 320.

A variety of materials may be utilized for first material layer 311 and second material layer 312, including various textiles, polymer sheets, leather, or synthetic leather, for example. Combinations of these materials (e.g., a polymer sheet bonded to a textile) may also be utilized for first material layer 311 and second material layer 312.

Although first material layer 311 and second material layer 312 may be formed from the same material, each of first material layer 311 and second material layer 312 may also be formed from different materials. With regard to textiles, first material layer 311 and second material layer 312 may be formed from knitted, woven, or non-woven textile elements that include rayon, nylon, polyester, polyacrylic, cotton, wool, or silk, for example. Moreover, the textiles may be nonstretch, may exhibit one-directional stretch, or may exhibit multi-directional stretch. Accordingly, a variety of materials are suitable for first material layer 311 and second material layer 312.

Although an exemplary embodiment of thigh cushioning component 324 is shown as a one-piece unit, other embodiments may include a plurality of pads to configure a cushioning component with particular parameters, in accordance for the particular area of the body which the cushioning component is being applied. Additionally, the thickness of pad 313 may vary depending upon various factors, including the type of material utilized for pad 313 and the desired level of protection. In general, however, the thickness of pad 313 may range from one to fifty millimeters or more when formed from a polymer foam material. Although pad 313 may exhibit a constant thickness between first material layer 311 and second material layer 312, the thickness may vary across the width of pad 313. For example, edges of pad 313 may be thinner than central areas of pad 313. Various apertures, gaps, and indentations may also be formed in pad 313 to enhance flexibility and breathability.

Pad 313 may also be formed from a variety of materials, including various polymer foam materials that return to an original shape after being compressed. As an alternative to polymer foam materials, pad 313 may also be formed as fluid-filled chambers. Examples of suitable polymer foam materials for pad 313 include polyurethane, ethylvinylacetate, polyester, polypropylene, and polyethylene foams. Moreover, both thermoplastic and thermoset polymer foam materials may be utilized. In some configurations of cushioning components 320, pad 313 may be formed from a polymer foam material with a varying density, or solid polymer or rubber materials may be utilized. Also, different pad 313 may be formed from different materials, or may be formed from similar materials with different densities.

Plate components 330 have an overall curved configuration that generally conforms to the shape of individual 10. Given that protective components 310 may be utilized to protect a thigh or hip of individual 10, plate components 330 may exhibit a curvature that corresponds with the thigh or hip, respectively. Additionally, plate components 330 may include various ribs (shown schematically) that enhance rigidity. In further configurations, plate components 330 may have a variety of other features that enhance the comfort or protective properties of apparel system 100 or protective component 310. For example, plate components 330 may define a plurality of apertures that enhance breathability or flexibility, plate components 330 may be formed from multiple materials that vary the rigidity or flexibility in different areas, or plate components 330 may have a varying thickness that also vary the rigidity or flexibility in different areas.

Plate components 330 are primarily formed from a semi-rigid or rigid polymer material, which may be a non-foamed polymer material. Examples of suitable polymer materials for plate components 330 include polyethylene, polyurethane, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate components 330. In some configurations, plate components 330 may also be formed from metal materials (e.g., aluminum, titanium, steel) or may include metal elements that enhance the strength and rigidity of plate components 330. Accordingly, a variety of materials may be utilized for plate components 330.

Protective elements 310, which include plate components 330 and cushioning components 320, may be assembled before or after attachment of the protective elements 310 to lower protective garment 300, for example. The assembly of protective elements is typically performed by humans, rather than by automated machines or robots. One reason for this is that the positioning and attachment of the plate component relative to be cushioning components, and of the cushioning component to the garment, are tasks which are not easily automated. A human eye and touch is preferable in such types of tasks, particularly since the plate and/or cushioning component may have an irregular shape and/or curvature which requires careful positioning and guiding through a sewing machine or stapling machine. Beneficially, a method for assembly of protective elements includes steps for facilitating a human when attaching a plate component to a cushioning component. Such methods are useful when a human needs to position and attach the plate component to the cushioning component, for example by using a hand held sewing machine, to ensure accuracy in the placement of the plate component.

Figure 3:
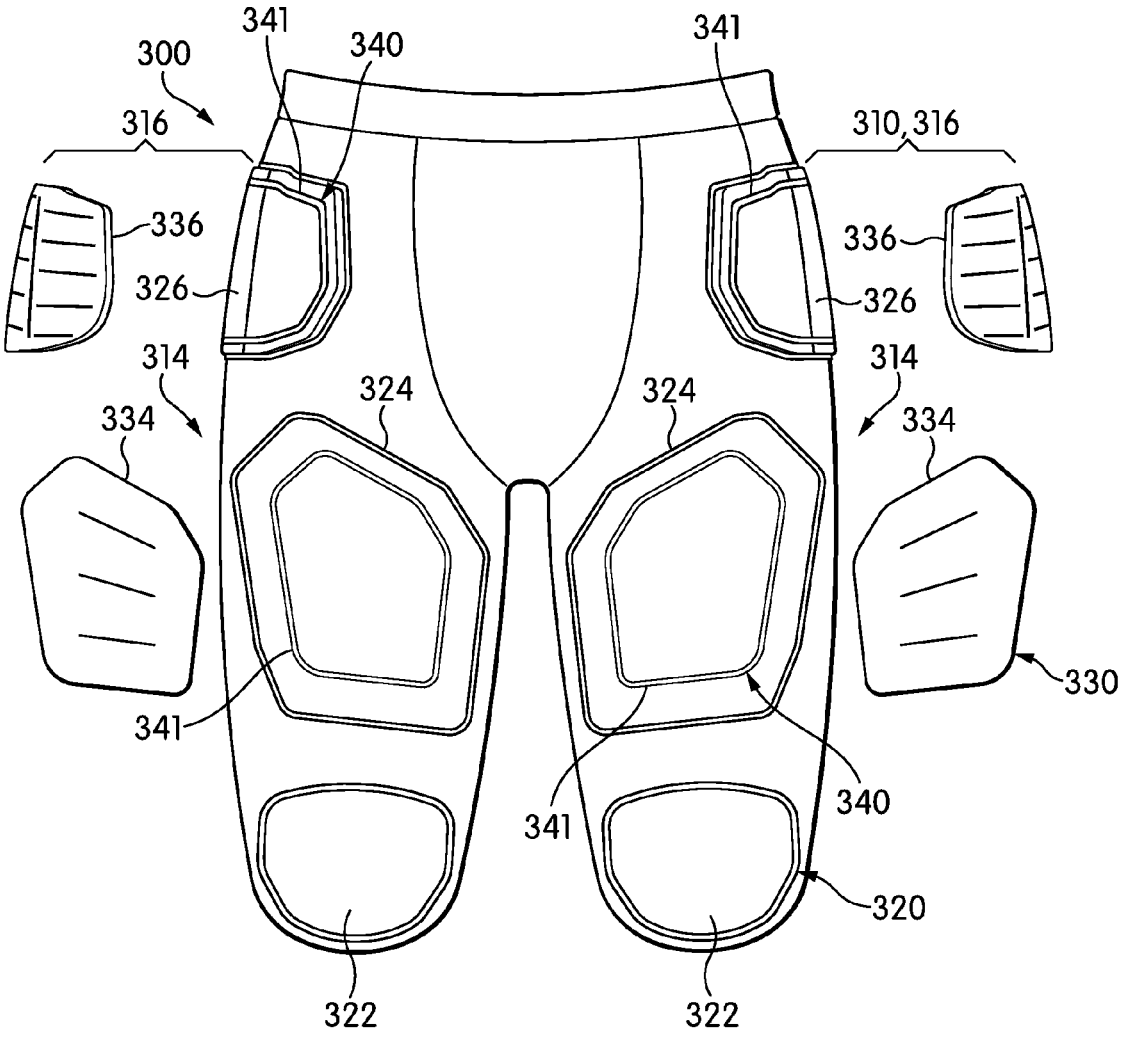
FIG. 3 is an exploded front elevational view of the lower protective garment of FIG. 2.
Figure 4:
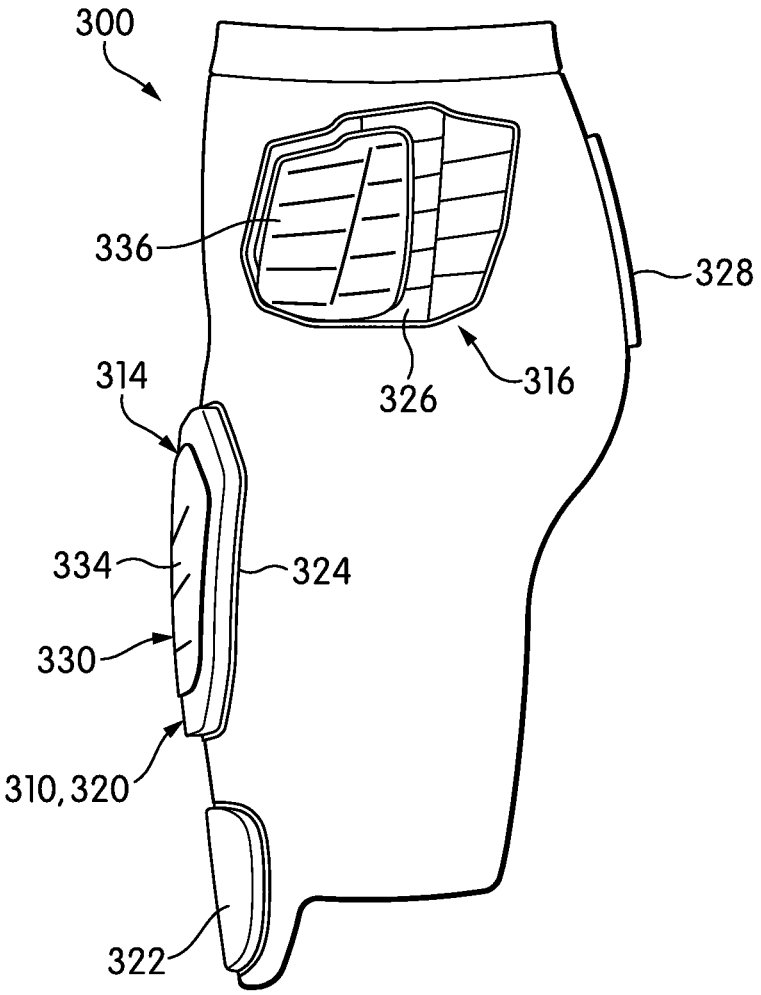
FIG. 4 is a side elevational view of an embodiment of the lower protective garment of FIG. 2.
Figure 5:
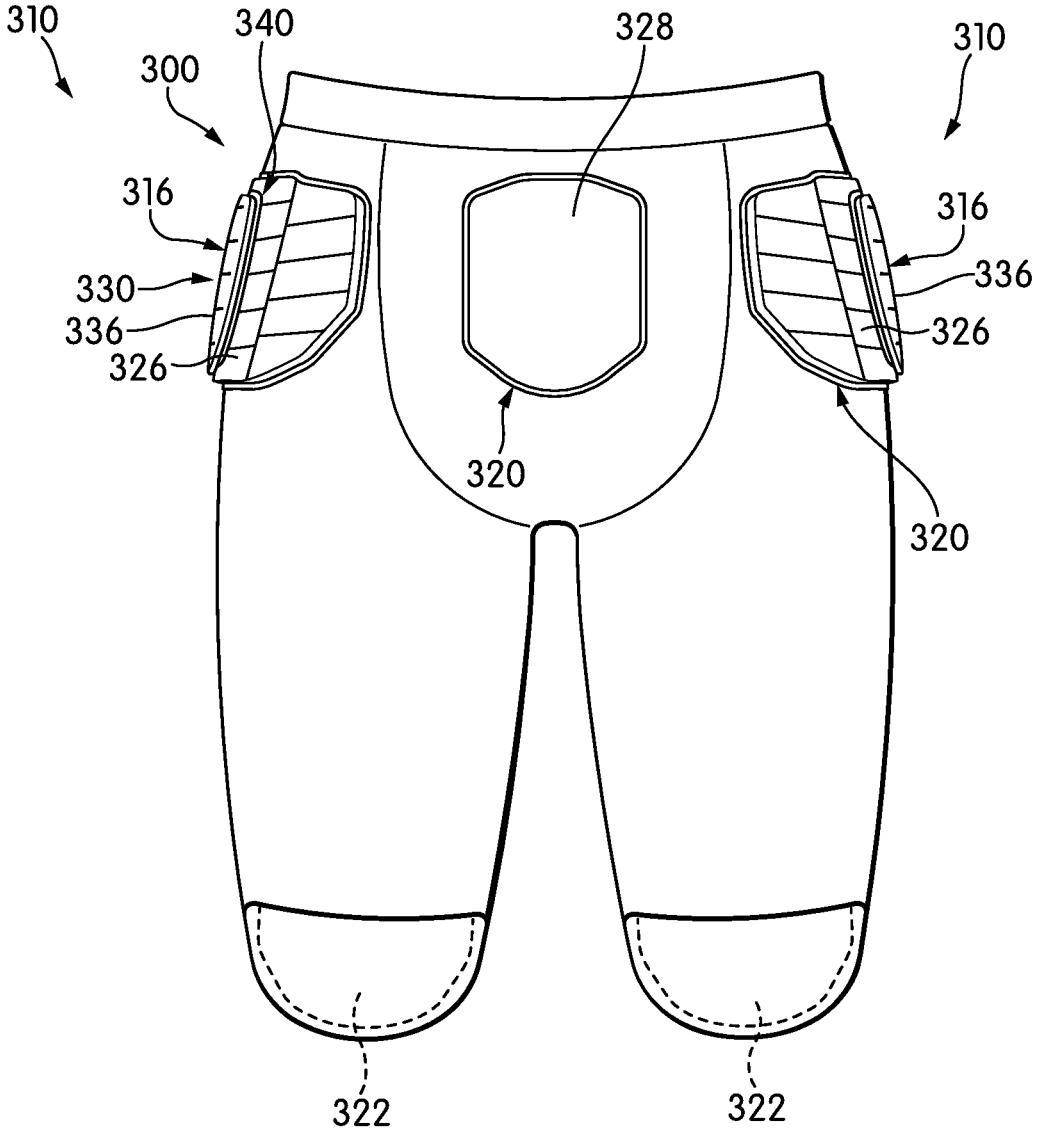
FIG. 5 is a rear elevational view of an embodiment of the lower protective garment of FIG. 2.
Figure 6:
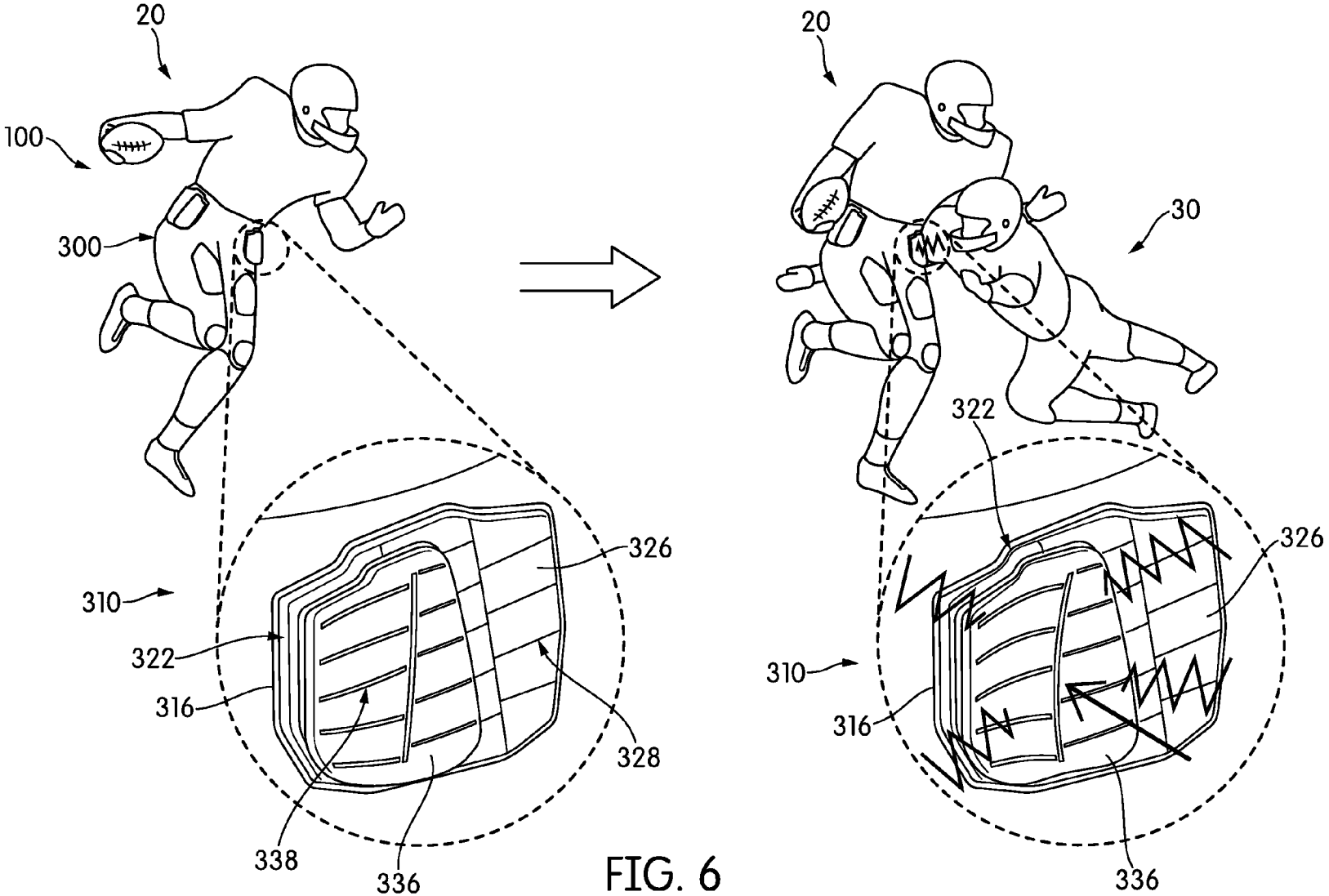
FIG. 6 is an illustration of a collision scenario of a first player wearing an embodiment of an apparel system with a second player.

According to an exemplary embodiment shown in FIG. 3, thigh cushioning components 324 and hip cushioning components 326 of protective elements 310 can be provided with a guide pattern 340 disposed on the exterior surfaces thereof. Guide pattern 340 can be configured in or on the thigh cushioning components 324 and hip cushioning components 326 to provide a visual guide to a person assembling the protective elements 310 of lower protective garment 300. More particularly, guide pattern 340 forms a visual guide for attaching thigh plate components 334 and hip plate components 336 to respective thigh cushioning components 324 and hip cushioning components 326 of protective elements 310.

Figure 8:
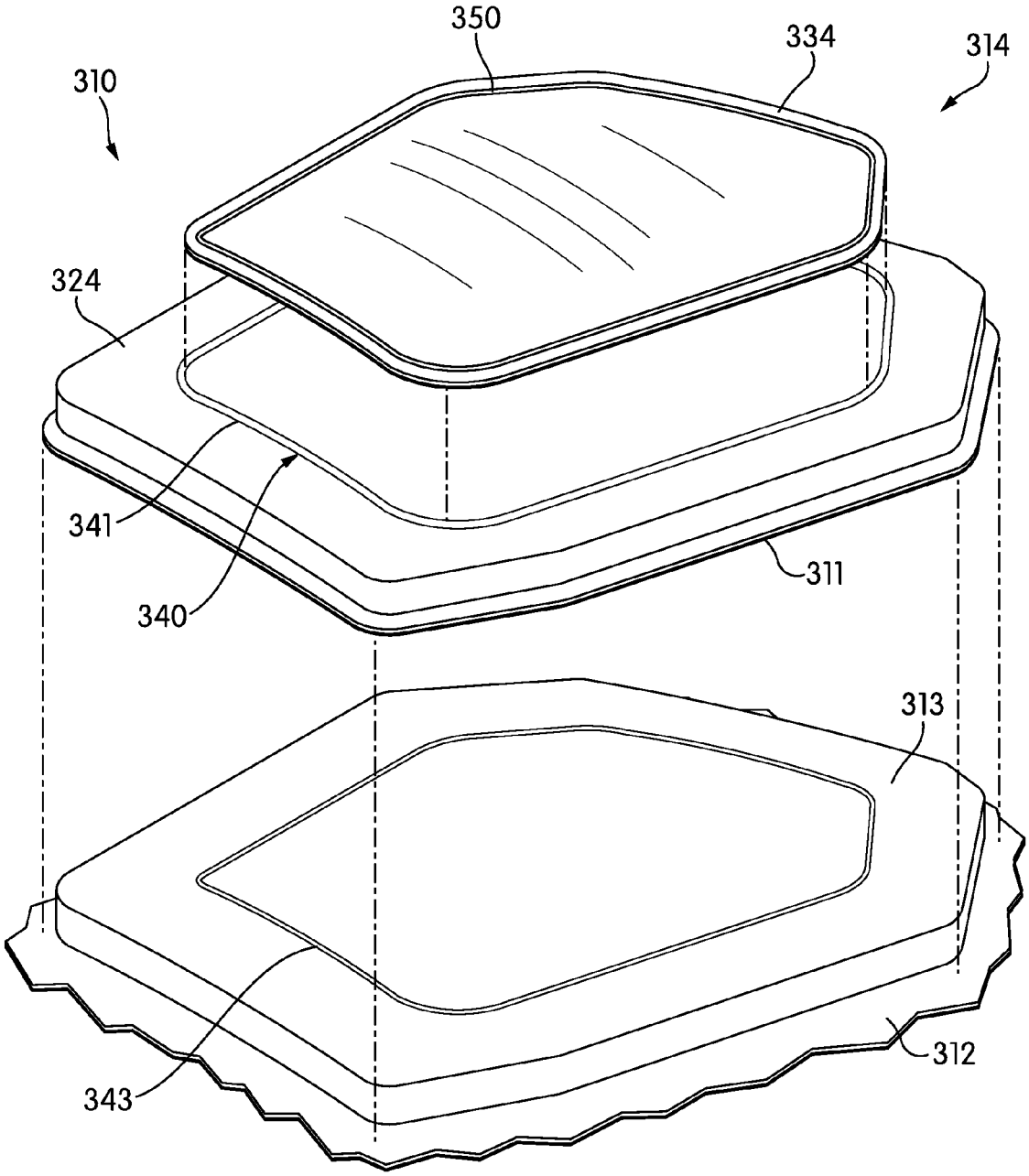
FIG. 8 is an exploded isometric view of an embodiment of a protective element.

In one configuration, a portion 341 of the first material layer 311 may be removed by a router, for example (not shown), or another cutting tool which thereby forms guide pattern 340 on the exterior of thigh cushioning component 324 (also see FIG. 8). This cutting creates a depression, groove, or incision in thigh cushioning component 324. The depression may have a bottom, which may be flat or curved, and sidewalls, which may be flat or curved. The sidewalls extend from the bottom to the exterior surface of the first material layer. The bottom of the depression may be between the exterior surface of first material layer 311 and an interior surface of first material layer 311. The bottom of the depression in some embodiments may be within the cushioning components. In such embodiments, the depression extends entirely through first material layer 311 and into the cushioning components. In some embodiments, sufficient material is removed so that the sidewalls are spaced apart from each other. In other embodiments, the sidewalls may touch in one or more positions along the depression or incisions.

In an exemplary embodiment, the first material layer 311 and the pad 313 may be different colors, such that the color of the pad is exposed through portion 341 of the first material layer that has been removed. For example, if the first material layer 311 is black and the pad 313 is red, the guide pattern appears because the red pad 313 is exposed at portion 341 of first material layer 311, and the contrasting colors make the guide pattern visible. Additionally, a portion 343 of the pad 313 may also be removed by routing, for example, at the same time or at a different time as the portion 341 of first material later 311, thereby forming an indentation in at least a top surface of pad 313 at portion 343. Not only may the guide pattern be useful for positioning a plate component on an appropriate portion of a cushioning component, but additionally, the indentation in portion 343 of pad 313 can be utilized to position a plate component relative to the pad and facilitate attachment of plate to the pad, as will be explained in detail below, with reference to FIG. 14.

As an alternative to routing the exterior of thigh cushioning component 324, guide pattern 340 may be formed by stitching through first material layer 311 to form a pattern of stitches left in first material layer (represented schematically). Additionally, guide pattern 340 may be formed by stitching through first material layer 311 and at least a portion of pad 313 to form an indentation in thigh cushioning component 324 at portion 341. Although these and the above configurations of the guide patterns on the cushioning component and the indentations in the pad are discussed with respect to protective elements 310 in the thigh area, the methods may also be applied to other protective elements in other areas of individual 10, such as with guide pattern 340 on hip cushioning components 326.

In some embodiments, the guide patterns may be configured to have a substantially equal or a smaller area than the plate components, so as to be hidden or covered when the plate component is attached to the cushioning component. Additionally, in some embodiments at least a portion of or all of the guide pattern may be configured to have a larger area than the plate components, so as to be at least partially visible or exposed when the plate component is attached to the cushioning component. Furthermore, the configuration of the guide pattern can vary in a thickness and a depth for example, which parameters may correspond to the shape of a particular plate component.

According to an exemplary embodiment shown in FIG. 8, the thigh plate component 334 of lower protective garment 300 can be provided with an attachment area 350 extending along a peripheral edge or perimeter thereof. Attachment area 350 can be configured to provide a reduced thickness portion of thigh plate component 334 at an area desirable to attach the plate component to the cushioning component. Generally, attachment area 350 may extend around the entire outer perimeter of the plate component, thereby encompassing the plate component. Attachment area 350 is formed in the thigh plate component 334 to allow for attachment of thigh plate component 334 to thigh cushioning component 324 at attachment area 350. Because the thickness of the material of the thigh plate components 334 is reduced at attachment area 350 compared to the rest of thigh plate components 334, stitching or stapling through thigh plate components 334 is more easily facilitated when attaching thigh plate component 334 to thigh cushioning component 324. Advantageously, because attachment area 350 extends around the entire perimeter of thigh plate component 344, the stitching or stapling provided in the attachment area also encompasses thigh plate component 334, thereby ensuring a secure attachment. Although in this configuration, attachment area 350 is shown in the perimeter of thigh plate component 334, alternative areas for providing an attachment area are possible. For example some attachment areas could be provided on alternating edges around the perimeter of a plate component, or in the middle of a plate component, or a combination thereof.

Figure 9:
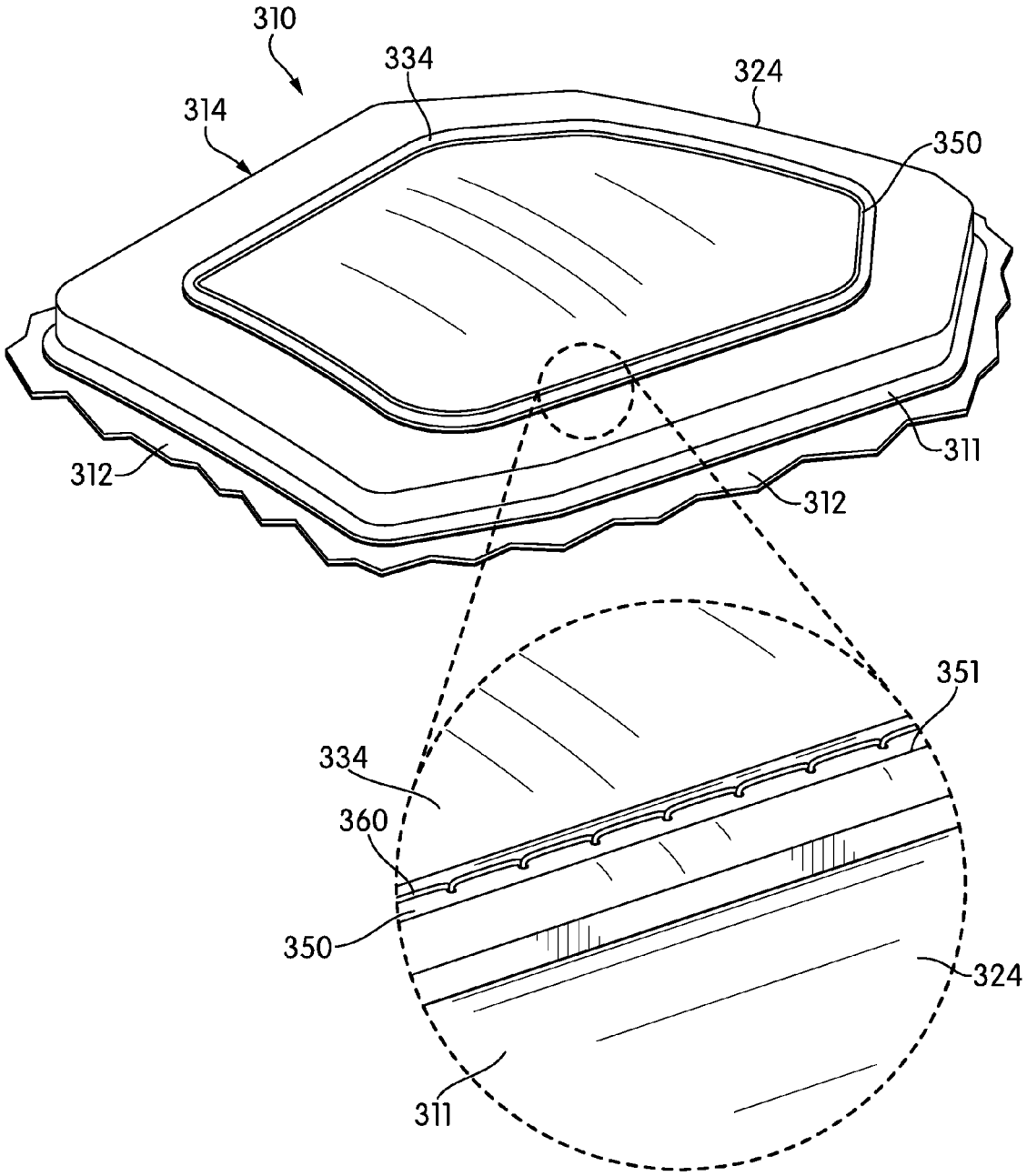
FIG. 9 is an isometric view of the protective element of the protective garment of FIG. 8, with a detailed view showing an embodiment for attaching a plate component to a cushioning component.
Figure 13A:
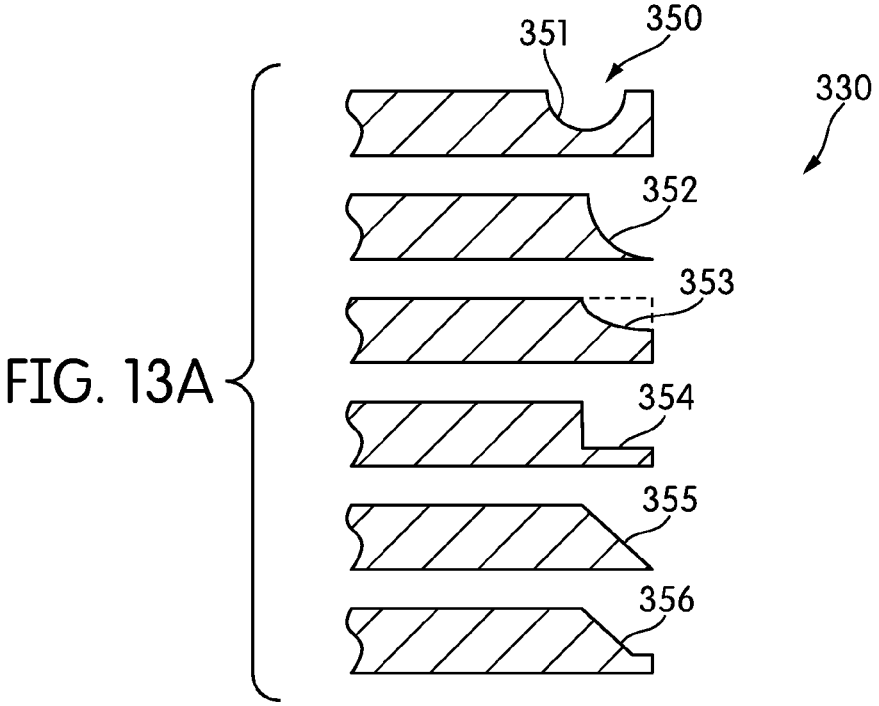
FIG. 13A shows cross-sectional views of various embodiments of an attachment area disposed near an edge of a substantially flat plate component.
Figure 13B:
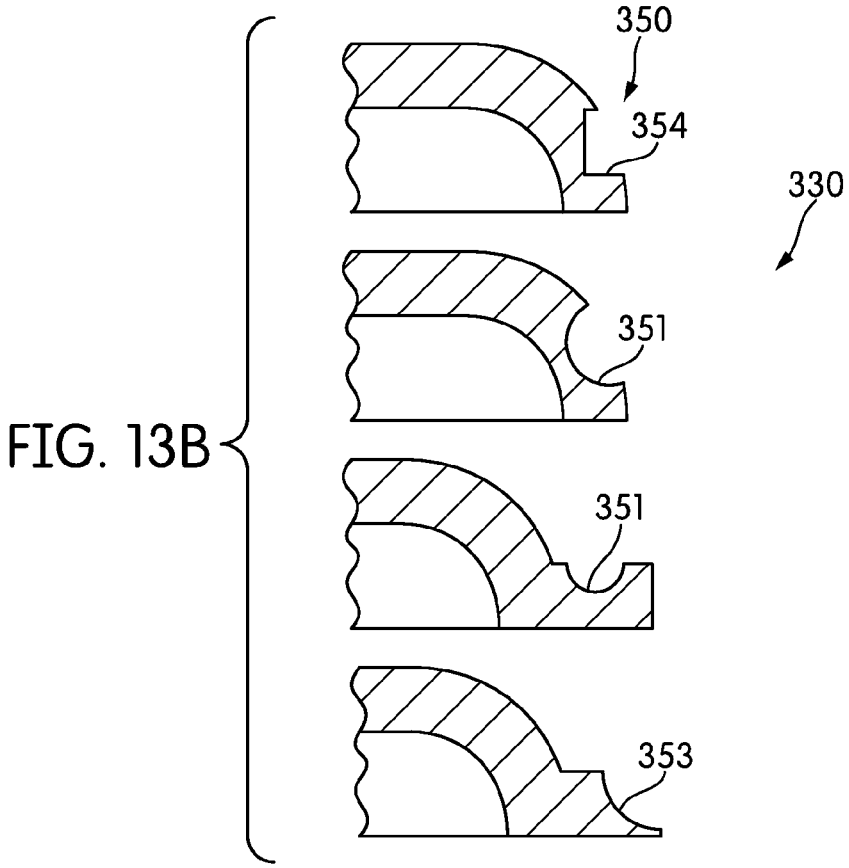
FIG. 13B shows cross-sectional views of various embodiments of an attachment area disposed near an edge of a substantially curved plate component.

As shown in detail in FIG. 9, in an exemplary embodiment, thigh plate component 334 has attachment area 350 provided near the peripheral edge or perimeter of the thigh plate component 334. Attachment area 350 may be configured as a groove or channel, which can be formed during manufacturing of the plate component, such as by a mold during injection molding. Alternatively, attachment area 350 could be formed by being routed into the plate component after manufacturing of the plate component, for example. Other exemplary configurations for attachment area 350 are shown in FIGS. 13A and 13B, which show cross-sectional views of generally flat-edged plate components and generally curved-edged plate components, respectively. In some embodiments, attachment area 350 may be configured as a groove or channel, having a semicircular profile 351. In other embodiments, attachment areas 350 can be configured as a channel having a partially semicircular profile 352 or a curved profile 353 cut into a top and outer edge of a plate component. In another embodiment, attachment area 350 may be configured as an "L" shaped notch 354, a slanted edge 355, or as a beveled edge 356.

In the exemplary embodiment shown in FIG. 9, thigh plate component 334 is attached to thigh cushioning component 324 by stitches or staples of attachment medium 360 provided in attachment area 350 of plate. In some embodiments, the thigh plate component 334 may have a thickness of 3.5 millimeters, for example. In such a case, attachment area 350 formed in the thigh plate component 334 can have a reduced thickness of 1.5 millimeters, for example. This enables an attachment device 362, such as a needle from a hand-held sewing machine, for example (shown schematically for simplicity), to penetrate more easily through the plate material, while maintaining the strength of thigh plate component 334 in attachment area 350. In some embodiments, stitches of attachment medium 360 are made in attachment area 350 of the plate at a rate of 4 to 6 stitches per inch. More or less stitches may be provided depending on the thicknesses of the plate component and of attachment medium 360.

Figure 10:
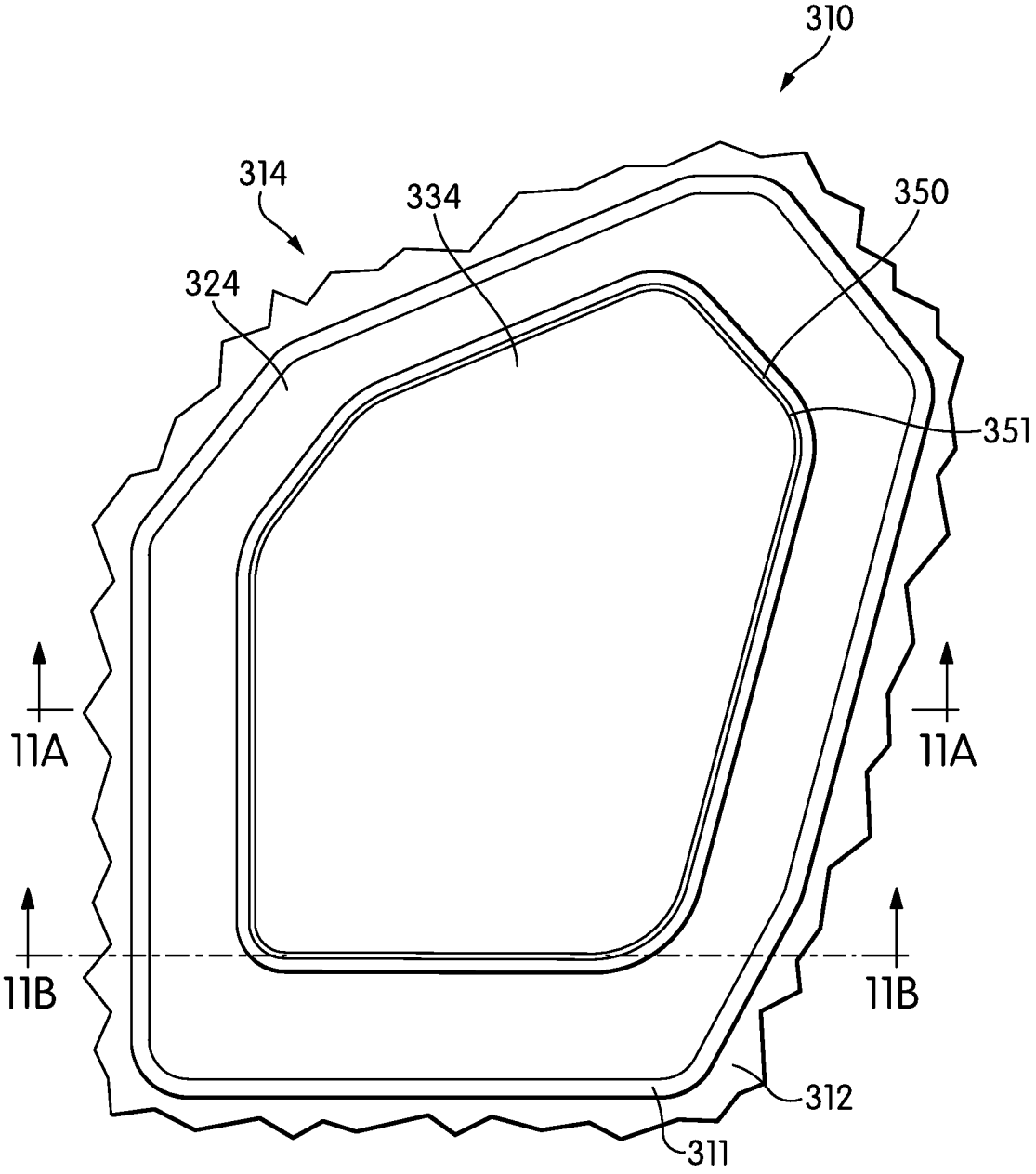
FIG. 10 is a top plan view of the protective element of FIG. 8.

In FIGS. 10 through 12, an exemplary embodiment for assembling protective component 310 is shown using a guide pattern and attachment area 350, described above. FIG. 10 shows a plan view of thigh protective element 314 having thigh plate component 334 positioned on thigh cushioning component 324. Although not visible, plate component 334 can be positioned on the appropriate area of thigh cushioning component 324 using guide pattern 340 (FIG. 8), in a manner so as to conceal guide pattern 340, which may be desirable in some embodiments. In this case, thigh plate component 334 is provided with attachment area 350 which can be formed as a groove, for example.

Figure 11A:
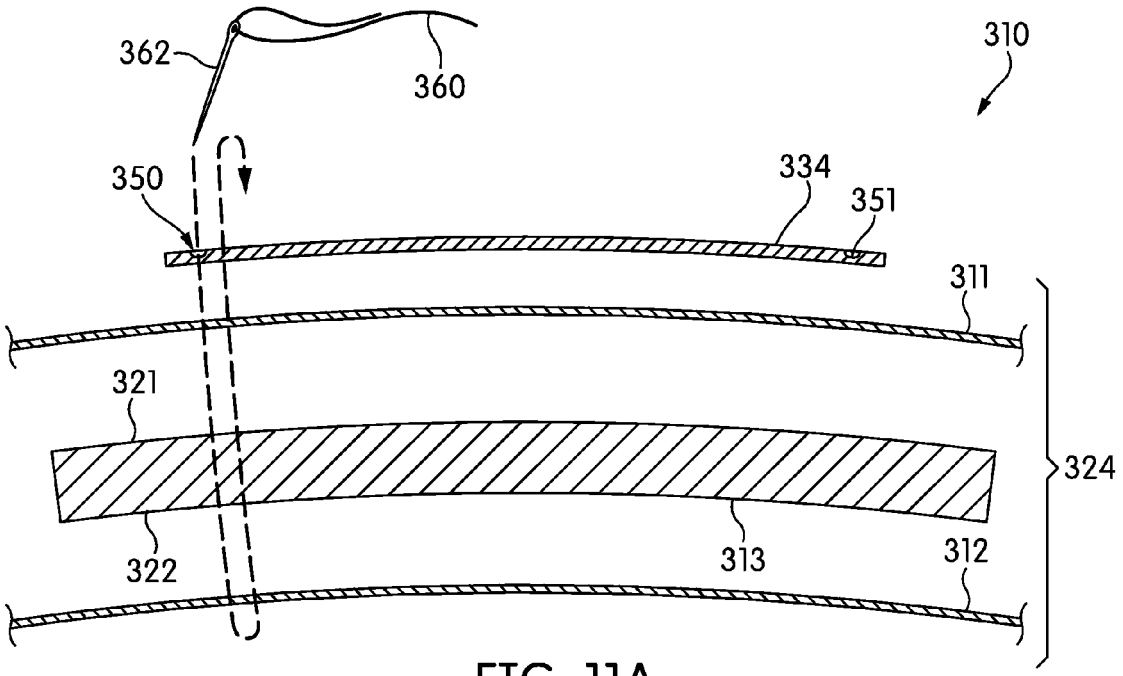
FIGS. 11A and 11B are exploded cross-sectional views of the protective element, as defined by section lines 11A and 11B in FIG. 10, respectively.
Figure 11B:
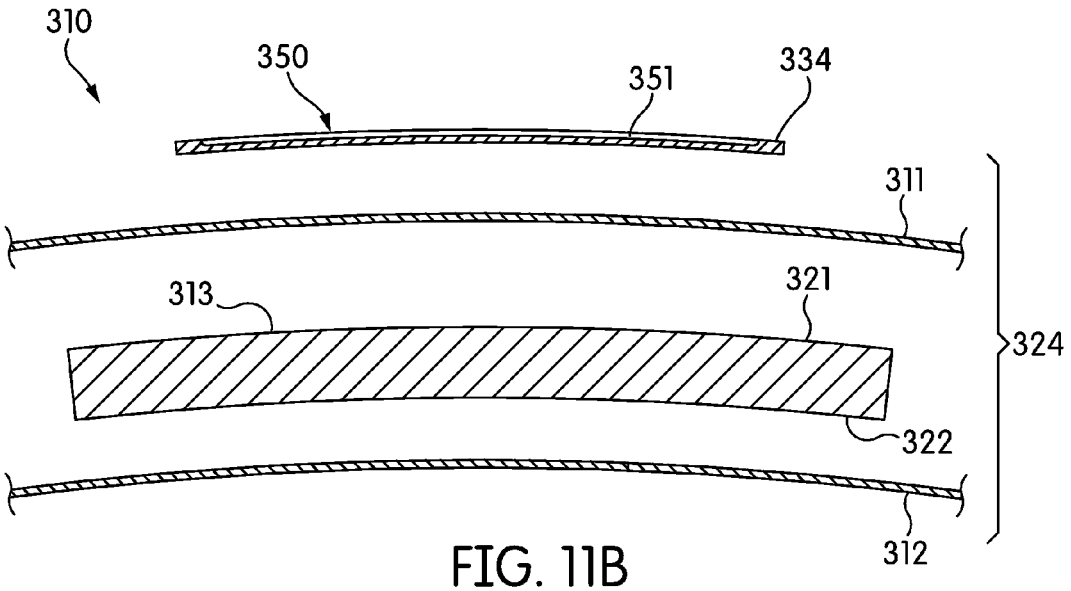
Figure 12A:
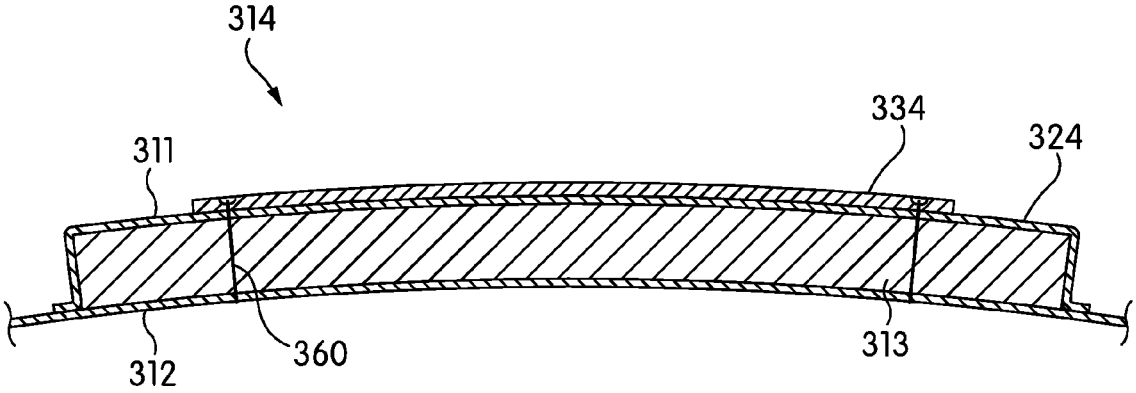
FIGS. 12A and 12B are cross-sectional views corresponding with the cross-sectional views of FIGS. 11A and 11B, respectively.
Figure 12B:
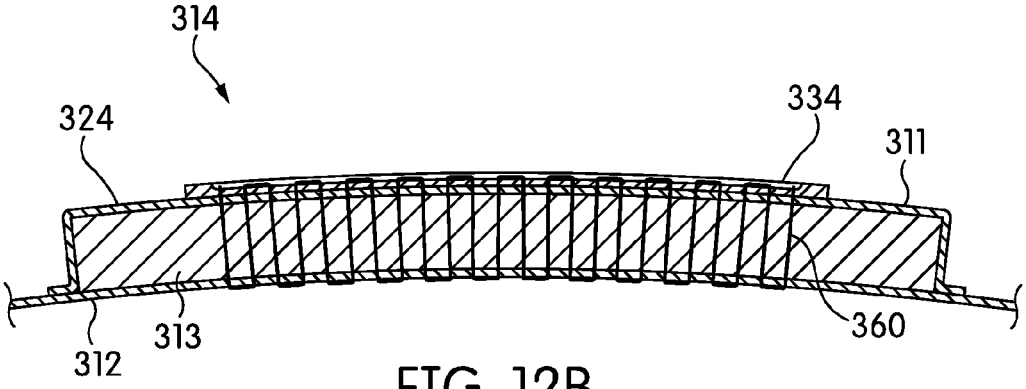

FIG. 11A demonstrates a simplified example of a stitching path (shown as a dotted line) for a needle 362 and stitching medium 360 to pass through thigh plate component 334 at attachment area 350. The stitching path continues then through first material layer 311, top surface 321 of pad 313, bottom surface 322 of pad 313, second material layer 312, and then back through to bottom surface 322 of pad 313, top surface 321 of pad 313, first material layer 311 and thigh plate component 334. FIGS. 11A and 11B represent the exploded cross-sectional views of FIG. 10 prior to a step of stitching, whereas FIGS. 12A and 12B represent cross-sectional views of FIG. 10 after a step of stitching. Although this configuration of attachment area 350 is discussed with respect to plate components 330 in the thigh area, the concept may also be applied to plate components 330 in other areas of individual 10, as will be explained below with reference FIG. 14.

Although shown here, in other embodiments, the pad component may omit the second material layer 312, and only include first material layer and pad 313. In such configurations, the plate component may be attached to the pad by the stitching method described above, however by stitching only through the plate component, the first material layer, to the bottom of pad, and then back through the first material and plate component. This may be desirable when the plate component is attached to the cushioning component prior to the cushioning component being attached to a garment such as lower protective garment 300.

Figure 14:
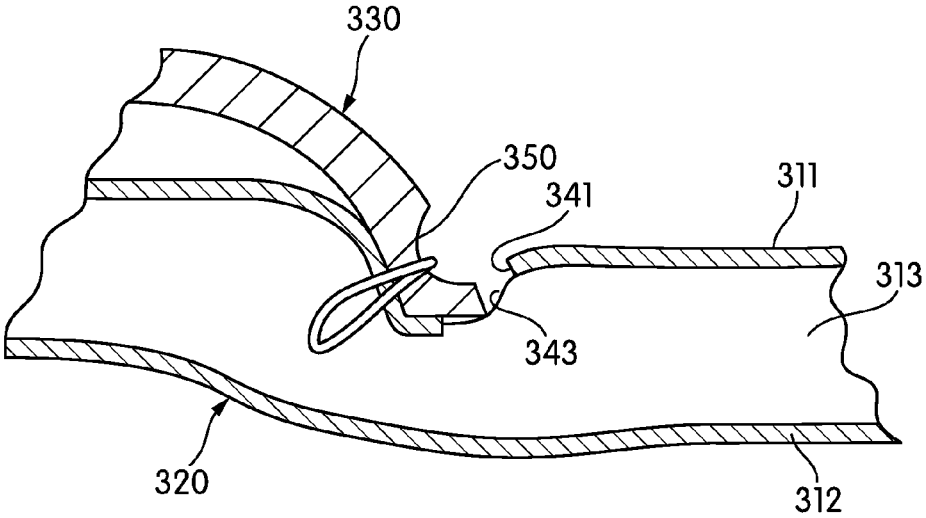
FIG. 14 is a detailed cross-sectional view showing an embodiment for attaching a plate component to a cushioning component.

FIG. 14 shows a detailed cross-sectional view of an embodiment for attachment of plate component 330 to cushioning component 320. According to an exemplary embodiment, plate component 330 of protective element 310 has a more curved configuration than thigh plate component 334 discussed above. Such a curved configuration of plate component 330 may be used in a protective element for the hip area, for example. Plate component 330 can be provided with an attachment area 350 disposed in the peripheral edge or perimeter thereof. Attachment area 350 can be configured to provide a reduced thickness portion of plate component 330 at an area desirable to attach plate component 330 to cushioning component 320.

To facilitate attachment of plate component 330 having the curved configuration at its peripheral edge, cushioning component 320 is provided with an opening at portion 341 of first material 311 and a coinciding indentation in portion 343 of pad 313, which are configured to receive the attachment area 350 of plate component 330. The opening at portion 341 of first material layer 311 is used as a visual guide to accurately position plate component 330 on cushioning component for attachment. It is advantageous to have the exterior of cushioning component 320 flush with the interior of plate component 330 at attachment area 350 to facilitate stitching through plate component 330 to cushioning component 320. Accordingly, attachment area 350 of plate component 330 is shown having first material later 311 and pad 313 disposed adjacently to the interior side of plate component 330. With this configuration, it is possible to stitch through plate component 330 at attachment area 350 at an angle which is more horizontal than vertical. A stitch is shown being made at an angle through attachment area 350, through first material layer 311, and into pad 313. In this configuration, the stitches (shown as an individual stitch for simplicity) are only partially disposed into and through the pad 313. However, other configurations having stitches passing entirely thought the pad 313 to the second material layer 312, or alternatively only passing through first material layer are also possible.

Figure 15:
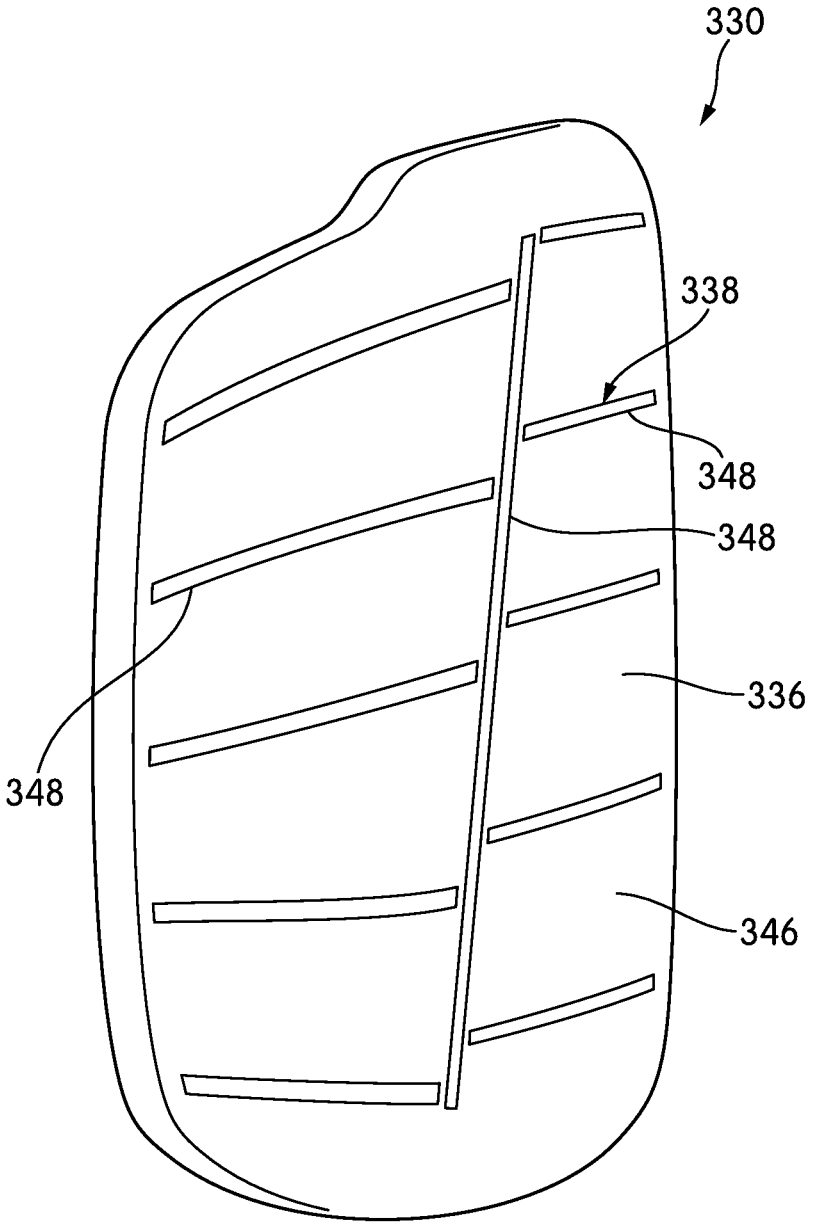
FIG. 15 is a perspective view of an embodiment of a curved plate component showing flex indentations.

Referring now to FIG. 15, an exemplary embodiment for plate component 330 will be described. Plate component 330 is configured as a hip plate component 336 having a plurality of flex indentions 338, which were described previously with reference to FIG. 6. Flex indentations 338 are configured to enhance flexibility and enable deformation of hip plate component 336 when exposed to an impact force. Flex indentations 338 may be provided on the exterior of hip plate component 336 and may be configured as grooves or channels, which can be formed during manufacturing of the plate component, such as by a mold during injection molding. Alternatively, flex indentations 338 could be formed by being routed into the plate component after manufacturing of the plate component, for example.

In one embodiment, flex indentation are formed within a first material 346 of plate component 330. A second material 348 can be disposed in the flex indentations 338, thereby filling in the flex indentations 338. Additionally, the second material 348 can have a greater flexibility and compressibility than first material 346, so as to provide cushioning and force attenuation at the flex indentation during deformation of the plate component 330. Second material 348 can be deposited onto first material 346 by co-molding for example. However, other methods of manufacturing are possible. Although this and the above configurations for flex indentations 338 provided in a plate component are discussed with respect to a hip plate component, the concepts may also be applied to plate components in other areas of a protective garment incorporating protective elements, such as thigh plate components 334, which show representative flex indentations in several of the figures, although not enumerated.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. Further, any element of any embodiment disclosed above may be used in any other embodiment unless specifically restricted.

What is claimed is:

1. A protective element for an article of apparel, the protective element comprising:

a first material layer having a first side and an opposite second side;

a second material layer associated with the first material layer;

a pad component located between the first material layer and the second material layer;

a plate component positioned adjacent to the first material layer, wherein the plate component is disposed adjacent the first side of the first material layer and the pad component is located adjacent the second side of the first material layer so that the first material layer is disposed between the plate component and the pad component, wherein the plate component has a first portion having a first thickness and a second portion having a second thickness, wherein the first thickness is greater than the second thickness;

an attachment area formed on an outer perimeter of the plate component, wherein the attachment area corresponds to the second portion so that the attachment area has the second thickness; and an attachment element that attaches the plate component to the first material layer, wherein the attachment element extends entirely through the second thickness of the attachment area.

2. The protective element according to claim 1, wherein the second material layer is a surface of the article of apparel.

3. The protective element according to claim 1, wherein the attachment element extends through the attachment area, the first material layer, and the pad component.

4. The protective element according to claim 1, wherein the attachment area extends around an entirety of the outer perimeter of the plate component, and the attachment element extends around the entirety of the outer perimeter of the plate component.

5. The protective element according to claim 1, wherein the attachment element is a thread stitched through the plate in the attachment area.

6. The protective element according to claim 1, wherein the first material layer includes a pattern, wherein the pattern corresponds to a shape of the attachment area.

7. The protective element according to claim 6, wherein the pattern is a visible difference from a remainder of the first material layer.

8. The protective element according to claim 7, wherein the attachment element extends through the pattern.

9. A protective element for an article of apparel comprising:

a plate component having a perimeter shape;

a first material layer having an exterior surface and an opposing interior surface, wherein the exterior surface is positioned adjacent to the plate component;

a pad component having a first surface that is positioned adjacent to an interior of the first material layer;

a guide pattern on the exterior surface of the first material layer opposite the interior adjacent the pad component, wherein the guide pattern corresponds to the perimeter shape of the plate component, wherein the plate component is positioned on the first material layer using the guide pattern; and an attachment element that attaches the plate component to the first material layer proximate the guide pattern.

10. The protective element according to claim 9, wherein the plate component has a greater rigidity than the pad component.

11. The protective element according to claim 9, wherein the guide pattern is an incision extending entirely through the first material layer that exposes the pad component.

12. The protective element according to claim 9, wherein the pad component has a first color and the plate component has a second color, wherein the first color is different from the second color.

13. The protective element according to claim 9, wherein the guide pattern is a depression in the first material layer, wherein the depression includes a bottom and sidewalls, wherein the bottom is disposed between the exterior surface of the first material layer and the interior surface of the first material layer, and wherein the sidewalls extend from the bottom to the exterior surface of the first material layer.

14. The protective element according to claim 9, wherein the guide pattern extends into the pad component.

15. The protective element according to claim 9, wherein the plate component is an energy dissipating element and the pad component is a cushioning element.

16. The protective element according to claim 9, wherein the protective element is attached to an outermost layer of an article of apparel.

17. The protective element according to claim 9, wherein the plate component includes a first portion and a second portion, wherein the first portion has a first thickness and the second portion has a second thickness, wherein the second thickness is less than the first thickness, and wherein the attachment element extends through the second portion.

18. A method for making an article of apparel configured with a pad component and a plate component, the method comprising the steps of:

placing the pad component adjacent to a first material layer;

forming an attachment area on a peripheral edge of the plate component, the attachment area substantially encompassing the plate component;

aligning the plate component over the pad component by placement of the plate component on the first material layer; and attaching the plate component to the pad component along the attachment area on the perimeter of the plate component, by inserting an attachment medium through the plate component and at least one of the first material layer and the pad component.

19. The method for making an article of apparel according to claim 18, wherein the attachment area is formed by reducing the thickness of the plate component.

20. The method for making an article of apparel according to claim 18, wherein the step of forming an attachment area is performed simultaneously with a step of forming the plate component.

21. The method for making an article of apparel according to claim 18, further comprising the steps of:

providing a guide pattern on the exterior of the first material layer opposite an interior of the first material that is adjacent to the pad component; and aligning the plate component with the guide pattern.

22. The method for making an article of apparel according to claim 18, further comprising the step of:

providing the first material layer with a different color than the pad component; and forming a guide pattern by exposing the pad component through the first material layer.

23. The method for making an article of apparel according to claim 18, wherein the guide pattern is formed by cutting the first material layer.

24. The method for making an article of apparel according to claim 18, wherein the guide pattern is formed by cutting both the first material layer and the pad component.

25. The method for making an article of apparel according to claim 24, wherein the first material layer and the pad component are cut after the first material layer is attached to the pad component.

26. The method for making an article of apparel according to claim 18, further comprising the step of:

attaching the plate component and pad component to a second material layer that is incorporated in a garment.

* * * * *